US010750846B2

(12) United States Patent
Zentil et al.

(10) Patent No.: US 10,750,846 B2
(45) Date of Patent: Aug. 25, 2020

(54) BUCKLE WITH REMOVABLE MULTI-TOOL

(71) Applicant: FIX MANUFACTURING, LLC, Laguna Beach, CA (US)

(72) Inventors: Anthony Norman Zentil, Laguna Beach, CA (US); Robert Jerome Stemen, Aliso Viejo, CA (US)

(73) Assignee: FIX MANUFACTURING, LLC, Laguna Beach, CA (US)

( * ) Notice: Subject to any disclaimer, the term of this patent is extended or adjusted under 35 U.S.C. 154(b) by 0 days.

(21) Appl. No.: 16/440,841

(22) Filed: Jun. 13, 2019

(65) Prior Publication Data

US 2020/0000211 A1 Jan. 2, 2020

Related U.S. Application Data

(63) Continuation of application No. 15/471,437, filed on Mar. 28, 2017, now Pat. No. 10,321,752.

(60) Provisional application No. 62/314,289, filed on Mar. 28, 2016.

(51) Int. Cl.

| | |
|---|---|
| ***A44B 11/00*** | (2006.01) |
| ***A45F 5/02*** | (2006.01) |
| ***B25F 1/04*** | (2006.01) |
| ***B25G 1/08*** | (2006.01) |

(52) U.S. Cl.

CPC ..... *A45F 5/021* (2013.01); *B25F 1/04* (2013.01); *B25G 1/085* (2013.01); *A44B 11/005* (2013.01); *A45F 2200/0575* (2013.01); *Y10S 224/904* (2013.01); *Y10T 24/40* (2015.01); *Y10T 24/4098* (2015.01)

(58) Field of Classification Search

CPC ... A44B 11/005; Y10T 24/4098; Y10T 24/40; Y10S 224/904; A45F 5/021; A45F 2200/0575; B25F 1/04

See application file for complete search history.

(56) References Cited

U.S. PATENT DOCUMENTS

| | | | |
|---|---|---|---|
| 749,995 | A | 1/1904 | Johnson |
| 1,508,963 | A | 9/1924 | Dorf |
| 1,568,022 | A | 1/1925 | Landrum |
| 1,753,765 | A | 4/1927 | Withers |

(Continued)

FOREIGN PATENT DOCUMENTS

| | | |
|---|---|---|
| CN | 2013-93624 | 2/2010 |

*Primary Examiner* — Justin M Larson

(74) *Attorney, Agent, or Firm* — Knobbe Martens Olson & Bear LLP

(57) ABSTRACT

A buckle, such as for a strap or belt, houses a compact multi tool that is removable from the buckle. The arrangement includes a retention mechanism so the removable multi tool stays secure even with excessive body motion. The buckle can be any type of buckle for a belt or other type of strap. The buckle can couple a belt or strap to itself to create a loop or can couple strap portions to one another. The buckle functionality can be provided by any suitable arrangement, such as a cam lock mechanism, a pin or post-in-hole arrangement or a snap-fit arrangement, for example and without limitation. The multi-tool can include one or more articulating (e.g., foldable) tool elements. In some configurations, the multi-tool comprises a sleeve that receives a body of the multi-tool. The sleeve can include tool features.

8 Claims, 28 Drawing Sheets

(56) References Cited

U.S. PATENT DOCUMENTS

| | | | | |
|---|---|---|---|---|
| 2,826,813 | A * | 3/1958 | Flocke | B26B 1/06 30/159 |
| 3,043,037 | A | 7/1961 | Lesser et al. | |
| 3,088,234 | A | 5/1963 | Lesser et al. | |
| 3,148,426 | A * | 9/1964 | Lesser | A44B 11/005 24/3.7 |
| 3,927,442 | A | 12/1975 | Foster | |
| 4,078,272 | A | 3/1978 | Mahon, III | |
| 4,209,117 | A | 6/1980 | Corinaldi et al. | |
| 4,384,390 | A | 5/1983 | Hayakawa | |
| 4,466,561 | A | 8/1984 | Slaughter | |
| 4,494,310 | A | 1/1985 | Slaughter | |
| 4,529,111 | A | 7/1985 | Hayakawa | |
| 4,616,383 | A | 10/1986 | Rohm | |
| 4,753,377 | A | 6/1988 | Poluhowich | |
| 4,942,663 | A | 7/1990 | Ray, Sr. | |
| 4,955,097 | A | 9/1990 | Roderer | |
| 5,123,579 | A | 6/1992 | Sugiyama | |
| 5,217,150 | A | 6/1993 | Chen | |
| 5,357,638 | A | 10/1994 | Mayzel | |
| 5,609,280 | A | 3/1997 | Smith | |
| 5,609,281 | A | 3/1997 | West | |
| 5,711,042 | A | 1/1998 | Chuang | |
| 6,286,168 | B1 | 9/2001 | Woodruff | |
| 6,564,678 | B1 | 5/2003 | Wang | |
| 6,574,817 | B2 | 6/2003 | Wu | |
| 7,111,402 | B1 | 9/2006 | Pearman | |
| 7,140,280 | B2 | 11/2006 | Hawkins et al. | |
| 7,784,655 | B2 | 8/2010 | Su | |
| 8,056,780 | B1 | 11/2011 | Bruns | |
| 8,245,892 | B2 | 8/2012 | Kriner | |
| 8,376,199 | B2 | 2/2013 | Ellis | |
| 8,727,193 | B2 | 5/2014 | Oelzant | |
| 9,215,911 | B1 | 12/2015 | Carnley | |
| 9,408,440 | B2 | 8/2016 | Sobbi | |
| 9,591,893 | B2 | 3/2017 | West | |
| 10,219,585 | B2 * | 3/2019 | Taylor | A44B 11/2526 |
| 10,321,752 | B2 * | 6/2019 | Zentil | B25G 1/085 |
| 10,441,034 | B2 * | 10/2019 | Anderson | A44B 11/005 |
| 2005/0274024 | A1 | 12/2005 | Jinliang | |
| 2006/0200996 | A1 | 9/2006 | Pearman | |
| 2007/0084892 | A1 | 4/2007 | Korlath | |
| 2011/0173759 | A1 | 7/2011 | Taiga | |
| 2012/0298703 | A1 | 11/2012 | Kriner | |
| 2013/0189631 | A1 | 7/2013 | Mojica | |
| 2016/0255916 | A1 | 9/2016 | Ozdowy | |
| 2017/0020234 | A1 | 1/2017 | Taylor | |
| 2017/0181503 | A1 | 6/2017 | West | |
| 2017/0273446 | A1 | 9/2017 | Zentil | |
| 2018/0049409 | A1 | 2/2018 | Sporn | |
| 2019/0200709 | A1 * | 7/2019 | Paik | A44B 11/005 |
| 2019/0261745 | A1 * | 8/2019 | Taylor | A44B 11/005 |

* cited by examiner

300C

300D

BUCKLE WITH REMOVABLE MULTI-TOOL

INCORPORATION BY REFERENCE TO ANY PRIORITY APPLICATIONS

This application is a continuation of U.S. application Ser. No. 15/471,437, filed Mar. 28, 2017, issued on Jun. 18, 2019, as U.S. Pat. No. 10,321,752, which claims which claims benefit of provisional U.S. Application No. 62/314,289, filed Mar. 28, 2016, which is herein incorporated by reference in its entirety and should be considered a part of this specification. Any and all applications for which a foreign or domestic priority claim is identified in the Application Data Sheet as filed with the present application are hereby incorporated by reference.

BACKGROUND

Field

Certain embodiments discussed herein relate to a buckle assembly, and more particularly, to belt buckle that houses a multi-tool.

Description of the Related Art

A multi tool is a tool that includes a variety of different tools. Multi tools can include a group of tools that are useful for certain sports (e.g., cycling, camping). For example, a multi tool for cycling can include a group of wrenches that have different sizes and configurations (e.g., flathead, hex) to match the differently sized bolts on a bike. A camping pocketknife can include a folding blade as well as other tools that can be handy for camping (e.g., a screwdriver, a can opener, a pair of tweezers). Foldable multi tools are known to provide compact storage for a group of tools. In a foldable multi tool, the individual tools of the multi tool can pivot between a folded configuration and an unfolded configuration. An individual tool of the multi tool can be used in the unfolded configuration and then moved to the folded configuration for storage.

A problem with multi tools is that they are often carried loose, which can result in loss of the multi tool. Multi tools can be stored at the hip of a user in a case that is threaded onto a belt. A problem with this style of multi tool is that it protrudes from the belt, making the multi tool susceptible to becoming entangled on items that brush past the user's body. What is needed is a multi-tool that can be stored in a secure and convenient way.

SUMMARY

The systems, methods and devices described herein have innovative aspects, no single one of which is indispensable or solely responsible for their desirable attributes. Without limiting the scope of the claims, some of the advantageous features will now be summarized.

In some embodiments, a multi tool buckle assembly is disclosed. The buckle assembly includes a buckle and a multi tool insert. The buckle includes a receptacle. The multi tool insert is removably securable within the receptacle. The multi tool insert includes a tool body that has at least one articulating tool element.

The buckle assembly of the preceding paragraph can further include one or more of the following features: The multi tool insert further includes a tool sleeve that is removably securable to the tool body. The tool sleeve includes one or more tool features. The tool sleeve and the tool body include a detent arrangement that inhibits unintentional separation of the tool sleeve and the tool body. The tool sleeve and the tool body include at least one pair of cooperating magnetic elements that inhibit unintentional separation of the tool sleeve and the tool body. The tool sleeve includes a plate portion that extends along one side of the tool body. The tool sleeve further includes a hook portion that extends around an end portion of the tool body. The buckle includes a biasing element that engages the multi tool insert to inhibit unintentional separation of the multi tool insert from the buckle. The buckle includes a base and a cover that are coupled to one another by one or more fasteners, with the fasteners also coupling the biasing element to the buckle. The buckle includes a base and a cover that are coupled to one another. The buckle operates on a cam lock principle. The multi tool insert includes tool elements and tool features adapted for use in one or more of the following applications: snowboarding, skateboarding and bicycling.

In some embodiments, a multi tool buckle assembly is disclosed. The buckle assembly includes a buckle and a multi tool insert. The buckle defines an envelope sized to receive the multi tool insert. The multi tool insert is removably securable within the envelope. The multi tool insert includes a tool body and a tool sleeve that is removably securable to the tool body. Each of the tool body and the tool sleeve includes a tool element or tool feature.

The buckle assembly of the preceding paragraph can further include one or more of the following features: The tool sleeve and the tool body include a detent arrangement that inhibits unintentional separation of the tool sleeve and the tool body. The tool sleeve and the tool body include at least one pair of cooperating magnetic elements adapted to inhibit unintentional separation of the tool sleeve and the tool body. The tool sleeve includes a plate portion that extends along one side of the tool body. The tool sleeve further includes a hook portion that extends around an end portion of the tool body. The buckle includes a biasing element that engages the multi tool insert to inhibit unintentional separation of the multi tool insert from the buckle. The buckle comprises a base and a cover that are coupled to one another by one or more fasteners, with the fasteners also coupling the biasing element to the buckle. The buckle includes a base and a cover that are coupled to one another. The buckle operates on a cam lock principle. The multi tool insert includes tool elements and tool features adapted for use in one or more of the following applications: snowboarding, skateboarding and bicycling.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1A:
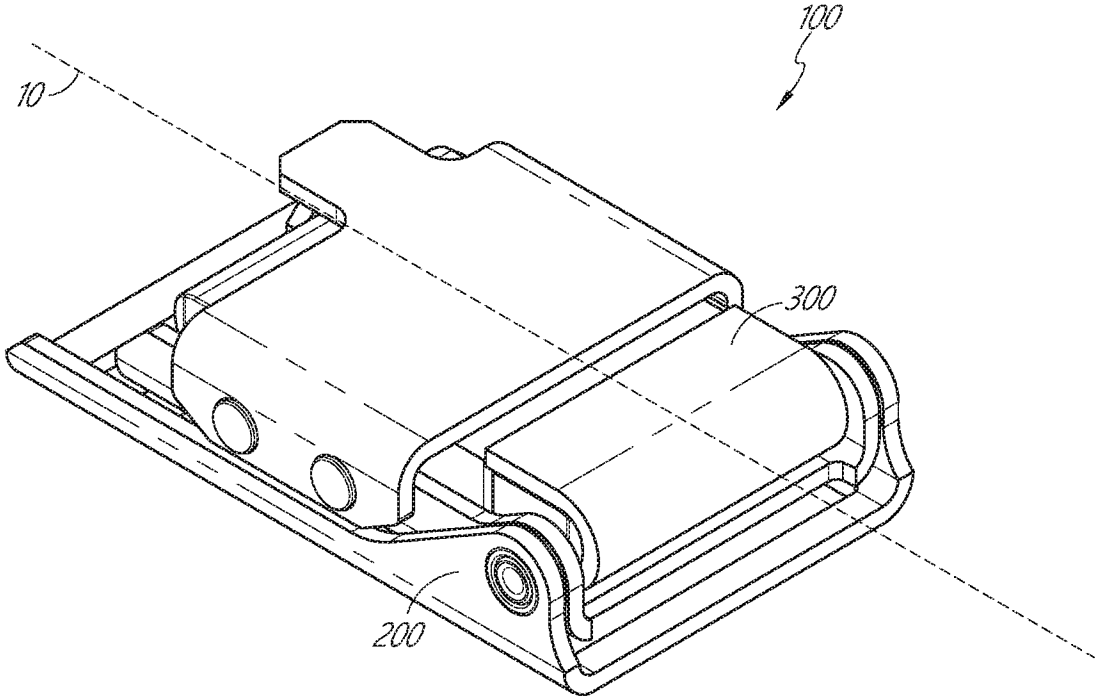
FIG. 1A is a front perspective view of a multi tool buckle assembly.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Overview

Figure 1B:
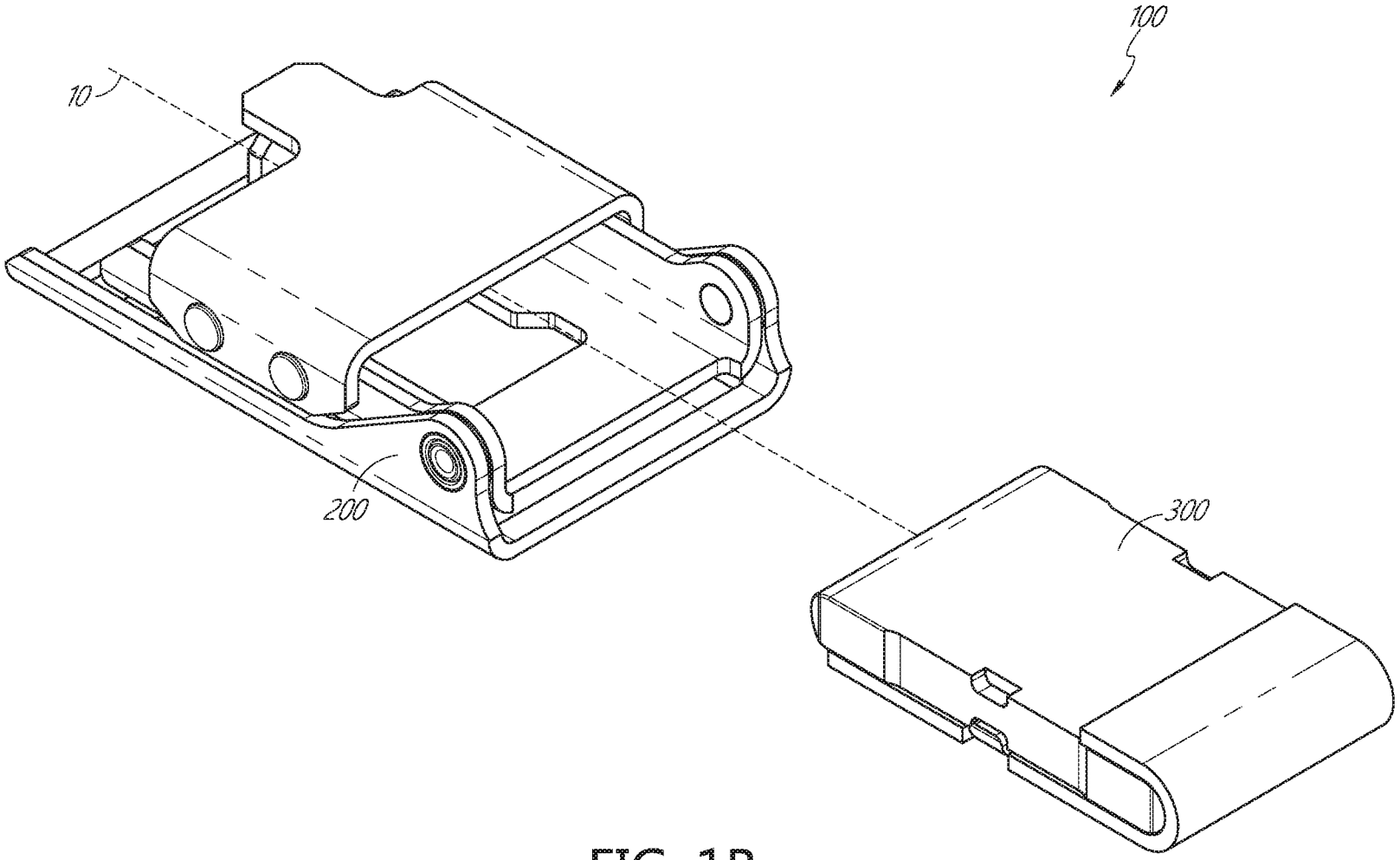
FIG. 1B is the multi tool buckle assembly of FIG. 1A with the multi tool insert removed from the buckle.

FIGS. 1A and 1B show a perspective view showing a front, top and side of a non-limiting, illustrative embodiment of a multi tool buckle assembly 100. As described in more detail below, embodiments of the multi tool buckle assembly 100 disclosed herein relate to a strap or belt buckle 200 that houses a compact multi tool insert 300. FIG. 1A shows the multi tool buckle assembly 100 with the multi tool insert 300 seated in the buckle 200. FIG. 1B shows the multi tool buckle assembly 100 with the multi tool insert 300 removed from the buckle 200. As shown in FIG. 1B, a user can slide the multi tool insert 300 along a longitudinal axis 10 to remove the multi tool insert 300 from the buckle 200.

The multi tool insert 300 is removable and, in at least some configurations, can be easily accessible at the waist of the user or at another location. As discussed below, the multi tool buckle assembly 100 can include a retention mechanism that is adapted so that the removable multi tool insert 300 stays secure inside the buckle 200 even with excessive body motion. The multi tool insert 300 can include one or more tools. A user can remove the multi tool insert 300 from the buckle 200 to allow the user to use the tools of the multi tool insert 300. The multi tool insert 300 can be stored in the buckle 200. A user can store the multi tool insert 300 in the buckle 200 when the user does not need to use the tools of the multi tool insert 300.

The buckle 200 can be any type of buckle for a belt or other type of strap. The buckle 200 can couple a belt or strap to itself to create a loop or can couple strap portions to one another. The buckle 200 functionality can be provided by any suitable arrangement, such as a cam lock mechanism, a pin or post-in-hole arrangement or a snap-fit arrangement, for example and without limitation. The multi-tool insert 300 can include one or more articulating (e.g., foldable) tool elements. In some configurations, the multi-tool insert 300 comprises a sleeve that receives a body of the multi-tool. The sleeve can include tool features, as discussed in more detail below.

Buckle

Figure 2A:
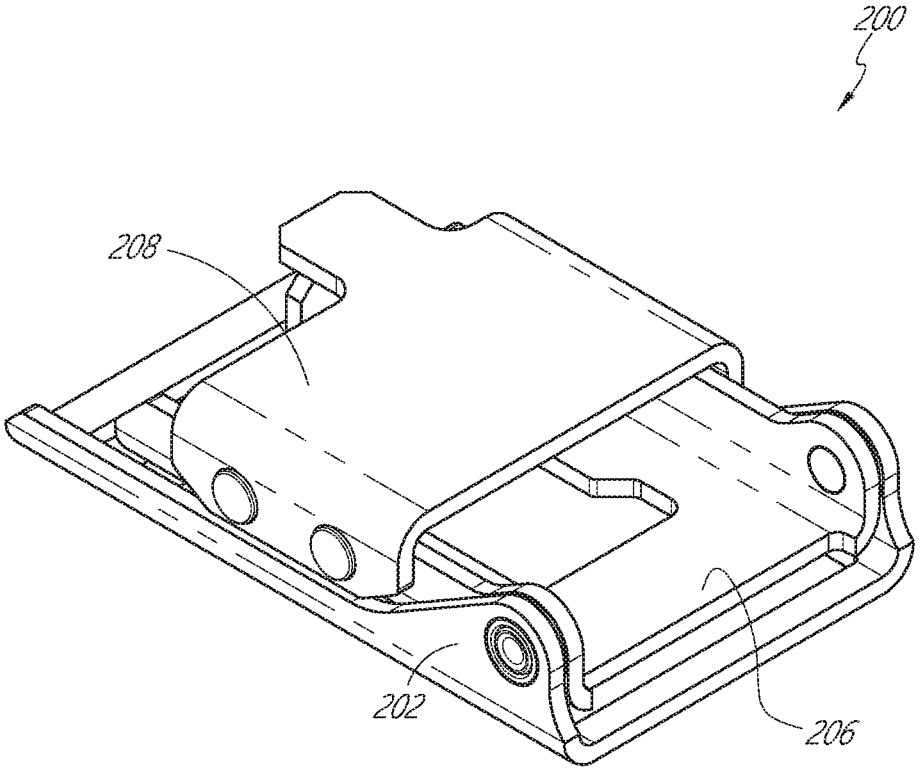
FIG. 2A is a top perspective view of a buckle of a multi tool buckle assembly.
Figure 2B:
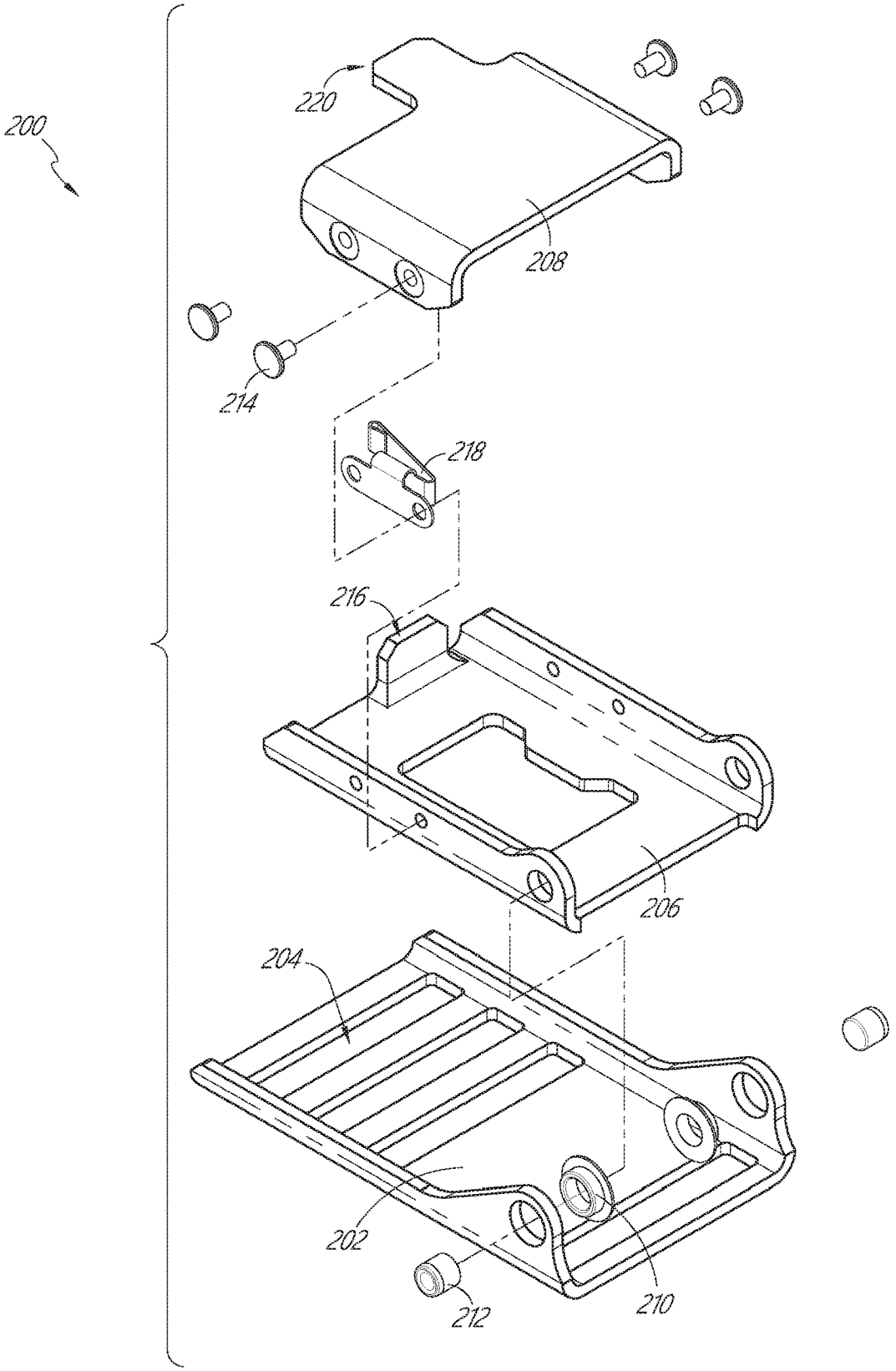
FIG. 2B is an exploded view of the buckle of FIG. 2A.

FIGS. 2A-2D show the buckle 200 of the buckle assembly 100 shown in FIGS. 1A and 1B. In the embodiment illustrated in FIGS. 2A-2D, the buckle 200 is a 2-piece cam style design. However, as described above, other buckle types can be used. A conventional woven or leather strap can pass over itself and clamp securely shut. FIG. 2A is a perspective view showing a front, top and side of the buckle 200. FIG. 2B shows an exploded view of the buckle 200 shown in FIG.

Figure 2C:
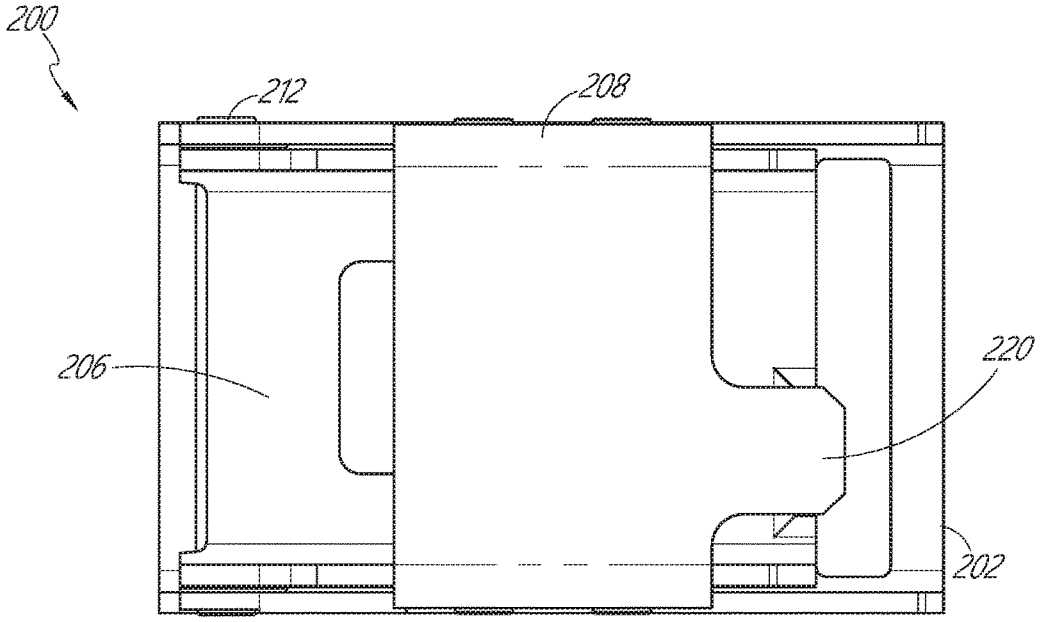
FIG. 2C is a top view of the buckle of FIG. 2A.
Figure 2D:
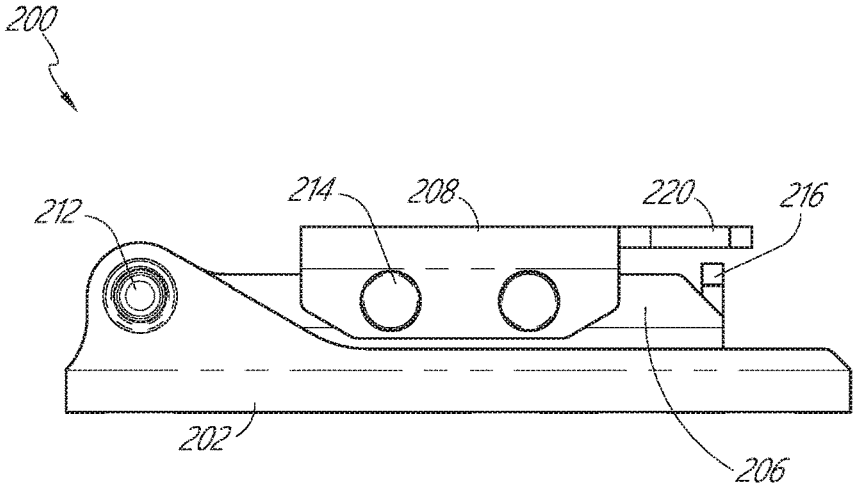
FIG. 2D is a side view of the buckle of FIG. 2A.

2A. FIG. 2C illustrates a top view of the buckle 200 shown in FIG. 2A. FIG. 2D illustrates a side view of the buckle 200 shown in FIG. 2A.

Referring to FIG. 2B, the buckle 200 can include a base plate 202 that is adjacent to the user's body and contains a common tri-glide pass through 204 (e.g., three openings) for the strap to accommodate different waist sizing. The buckle 200 can include a pivoting tool base 206 and a tool cover 208. The tool base 206 can be connected to the tool cover 208, as shown in FIG. 2A. The pivoting tool base 206 can serve as the cam mechanism to clamp the strap. The tool base 206, when connected to the tool cover 208, can house the multi tool insert 300, as described below. The cam action of the tool base 206 can be achieved by pivoting the tool base 206 relative to the base plate 202. The tool base 206 can pivot by way of a bushing 210 and a dowel pin 212 that rotatably couple the tool base 206 to the base plate 202.

The tool base 206 and the tool cover 208 can be held together by rivets 214. As described below, the tool base 206 and the tool cover 208 can form an envelope that stores the multi tool insert 300. As shown in FIG. 1A, the multi tool insert 300 can be stored in the space between the tool base 206 and the tool cover 208. In at least some configurations, the multi tool insert 300 can only be inserted into the buckle 200 in one direction. As shown in FIG. 2B, the tool base 206 can include a hard stop 216 (e.g., tab) that prohibits the multi tool insert 300 from exiting the end of the tool base 206 that has the hard stop 216. In the illustrated embodiment, the hard stop 216 is at the end opposite of the pivot formed by the bushing 210 and the dowel pin 212, with the multi tool insert 300 being removed from the buckle 200 by sliding the multi tool insert 300 away from the hard stop 216. In some embodiments, the hard stop 216 is at the same end as the pivot formed by the bushing 210 and the dowel pin 212, with the multi tool insert 300 being removed from the buckle 200 by sliding the multi tool insert 300 away from the pivot formed by the bushing 210 and the dowel pin 212.

The buckle 200 can include a spring clip 218 that inhibits or prevents the multi tool insert 300 from disengaging from the buckle 200 as a result of normal forces encountered during sport applications, or other intended applications. However, the user can manually overcome the spring clip 218 tension with finger pressure applied to the multi tool insert 300 opposite where the tool 300 enters the tool cover 208, such as beside the hard stop 216. The tool cover 208 can include a lever 220 opposite the pivot end for opening and closing of the cam mechanism. The buckle 200 can be sized to accommodate, for example, a 1.5" wide belt that is substantial enough to handle the weight of the multi tool buckle assembly 100 but narrow enough to fit thru standard apparel belt loops.

Multi Tool Insert and Mounting Platform

Figure 3A:
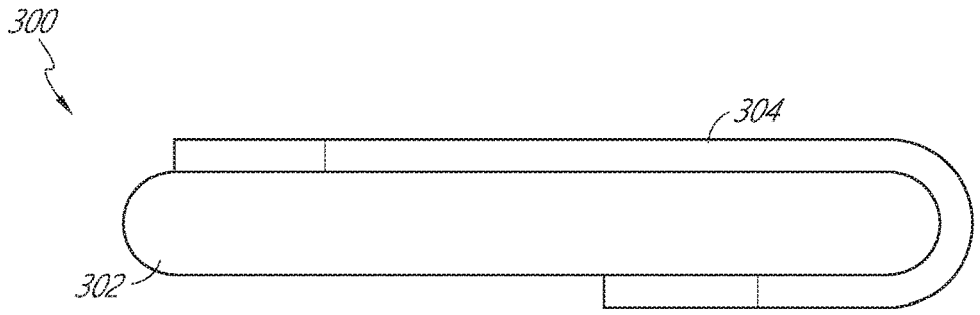
FIG. 3A is a side view of a multi tool insert.
Figure 3B:
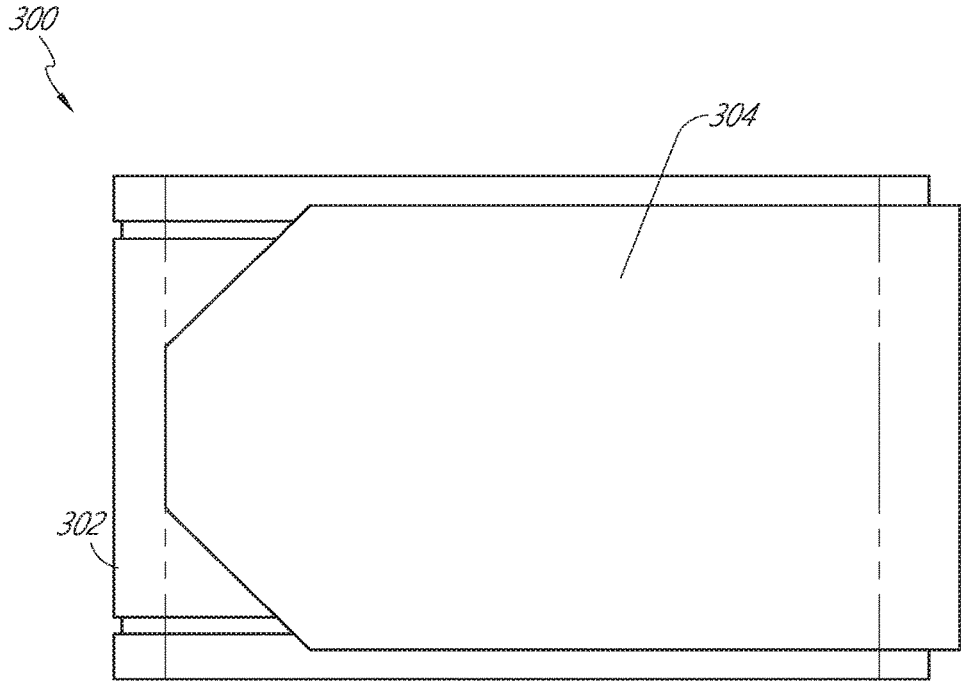
FIG. 3B is a rear view of the multi tool insert of FIG. 3A.

Several example tool combinations are illustrated herein for different sport applications. However, the multi tool insert 300 can be designed for other sports, activities or uses, as well. A generic multi tool insert 300 (or a dimensional envelope thereof) is illustrated in FIGS. 3A and 3B. FIG. 3A is a side view of the multi tool insert 300. FIG. 3B is a rear view of the multi tool insert shown in FIG. 3A. For the purposes of describing the tool insert 300, the front face of the multi tool insert 300 is taken to be the face of the tool 300 that faces away from the base plate 202 when the multi tool insert 300 is seated in the buckle 200. In other words, the rear face of the multi tool insert 300 is interposed between the base plate 202 and the front face of the multi tool insert 300 when the multi tool insert 300 is seated in the buckle 200.

The multi tool insert 300 can include a tool body 302 and a tool sleeve 304. As described in more detail below, the tool body 302 can be inserted into the tool sleeve 304, as shown in FIG. 3A. The tool sleeve 304 can cover at least a portion of the tool body 302. In the embodiment shown in FIG. 3A, the tool sleeve 304 covers the rear face of the tool body 302 to a greater extent than it does the front face of the tool body 302. In some configurations, the multi tool insert 300 has allowable dimensions of 57 mm×34.2 mm×9 mm to fit into the buckle 200. The thickness of the multi tool insert 300 does not have to be uniform because in certain arrangements only about 75% of the outside face (e.g., the front face) of the multi tool insert 300 is inserted into the buckle 200, as shown in the illustrated arrangement of FIG. 1A. The exposed thickness of the multi tool insert 300 can be thicker (e.g., 11.2 mm).

FIGS. 4A-4F illustrate one example of a multi tool insert 300A designed for snowboarding. The multi tool insert 300A is similar to the multi tool insert 300 except as described differently below. The features of the multi tool insert 300A can be combined or included with the multi tool insert 300 or any other embodiment discussed herein. In some configurations, the multi tool insert 300A includes a tool body 302A and a tool sleeve 304A similar to the tool body 302 and the tool sleeve 304 except as described differently below. The tool body 302A can include one or more tools 306A. The tools 306A can pivot on one of two available axes. The tools 306A can be attached to the tool body 302A by a tool pivot 310A. In the illustrated embodiment, only one tool pivot 310A is used to secure tools 306A to the tool body 302A. In some configurations, two tool pivots 310A are used to secure tools 306A to the tool body 302A (see, e.g., FIG. 6B). The tool sleeve 304A can be removable from the tool body 302A. The tool sleeve 304A can include one or more through holes 308A. The through hole 308A can be sized to serve as a wrench. The tool sleeve 304A can be used separate or in conjunction with the tool body 302A, such as in a nut and bolt tightening situation.

Figure 4A:
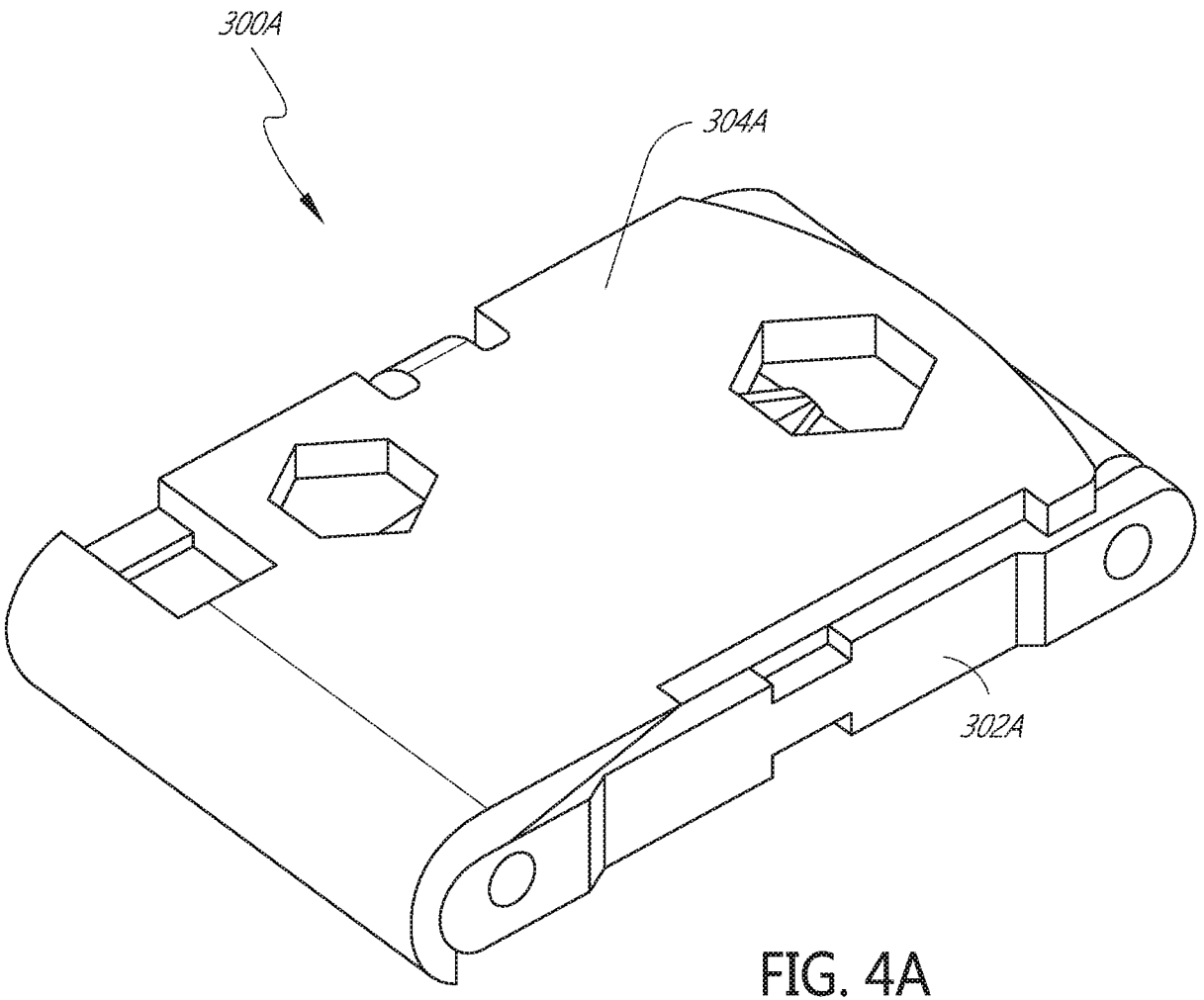
FIG. 4A is a rear perspective view of a multi tool insert.
Figure 4B:
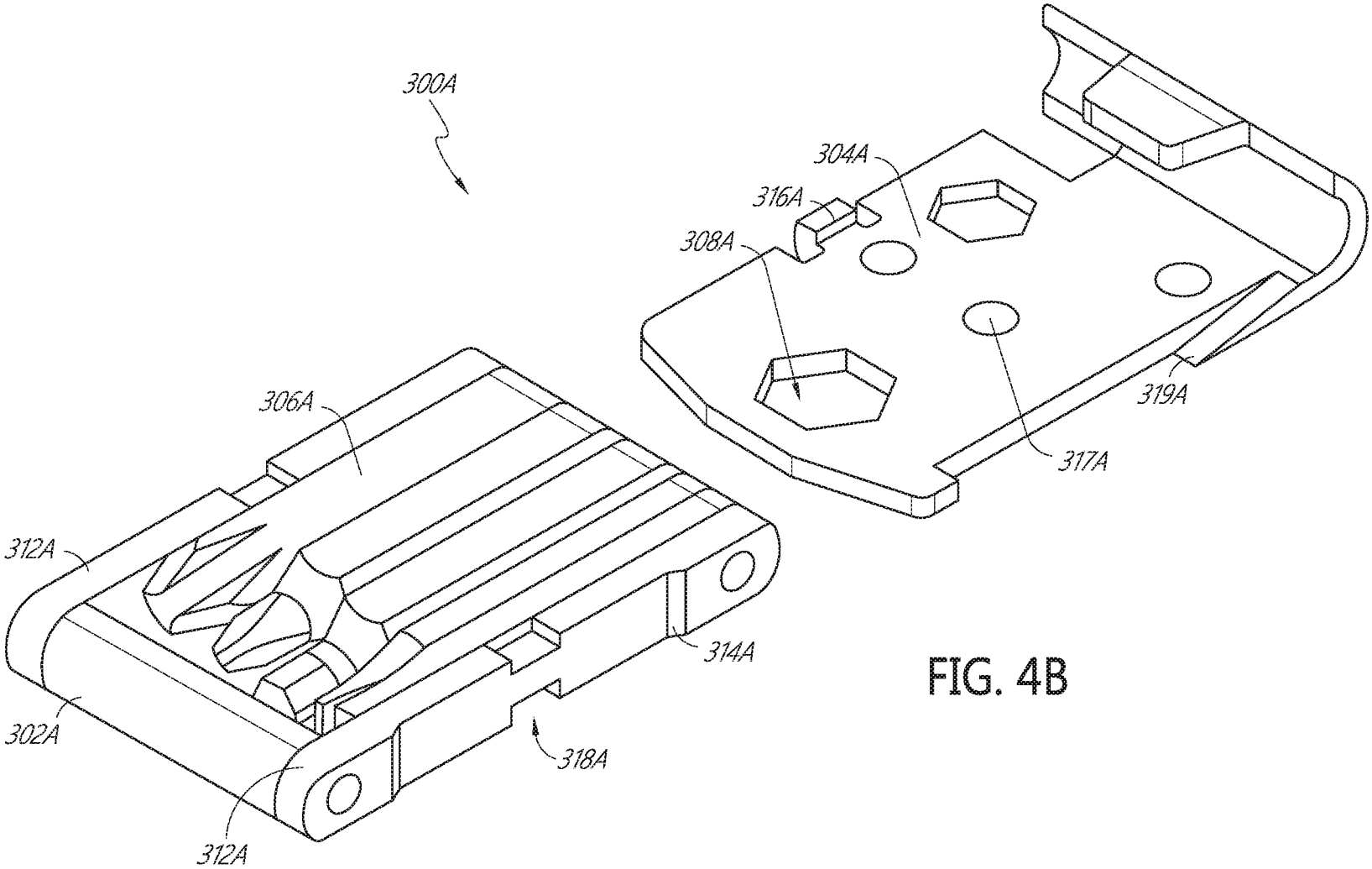
FIG. 4B is a front exploded view of the multi tool insert of FIG. 4A, showing the multi tool body removed from the sleeve.
Figure 4C:
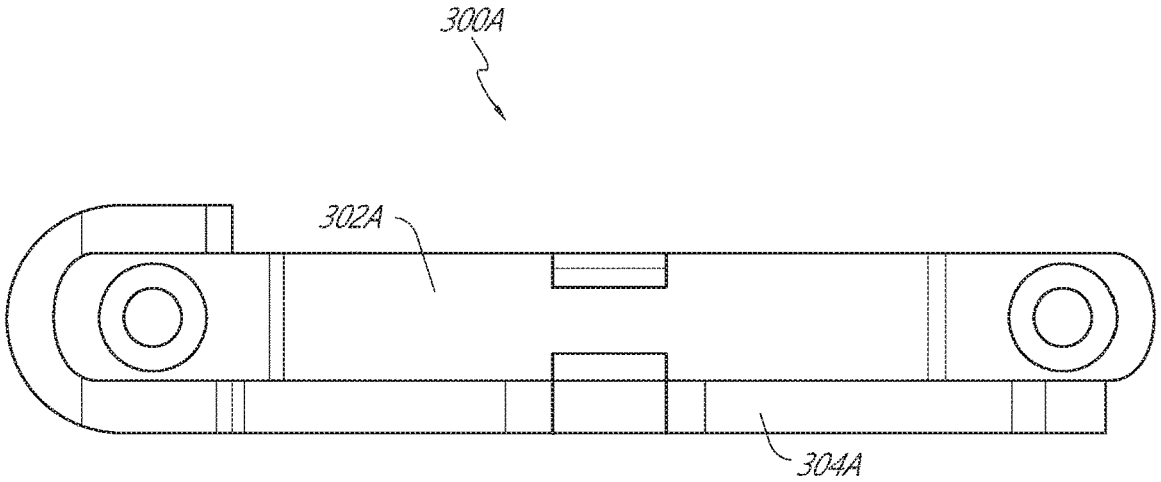
FIG. 4C is a side view of the multi tool insert of FIG. 4B.
Figure 4D:
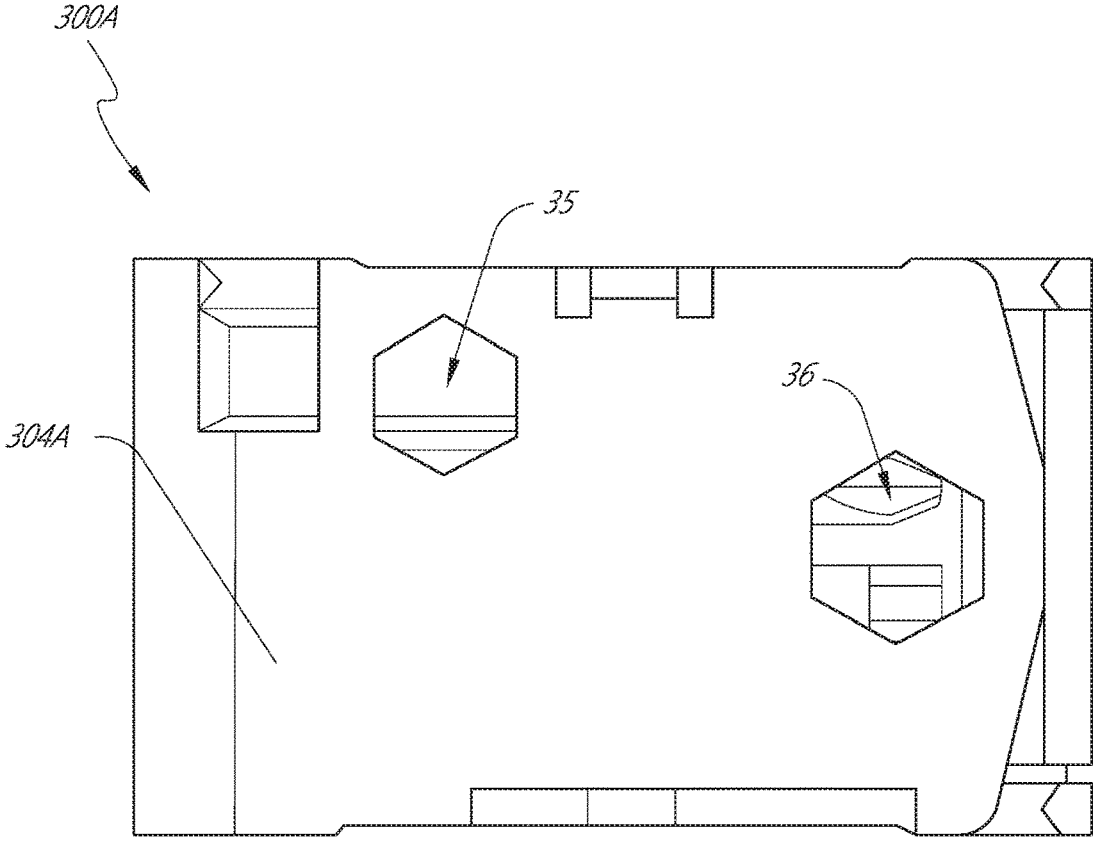
FIG. 4D is a rear view of the multi tool insert of FIG. 4C.

Referring to FIG. 4B, the tool body 302 can include a pair of spaced apart retention plates 312A. The tools 306A can be sandwiched and secured between the retention plates 312A. The retention plates 312A can include a retention feature that engages with the spring clip 218 of the buckle 200 (shown in FIG. 2B) so that the multi tool insert 300A does not disengage during sport applications but can be manually removed with finger pressure. For example, the unique geometry of the face on the retention plates 312A can be configured to interlock with the spring clip 218 of FIG. 2B. In the illustrated arrangement, each of the retention plates 312A defines a recessed portion that forms a shoulder 314A near the pivot 310A, as shown in FIG. 4B. The spring clip 218 can extend into the recessed portion and resist the shoulder 314A moving past the spring clip 218. The shoulder 314A can be forced past the spring clip 218 when a user applies finger pressure to the multi tool insert 300A, as described previously.

With continued reference to FIG. 4B, the tool sleeve 304A can include a post 316A and magnets 317A to properly index with the tool body 302A. The post 316A can engage a slot 318A in the retention plate 312A to function as a detent arrangement and secure the tool body 302A to the tool sleeve 304A against unintentional separation. The detent arrangement can resist or prohibit shear forces from separating the tool body 302A from the tool sleeve 304A when the tool insert 300A is slid into or out of the buckle 200. In the illustrated arrangement, each retention plate 312A includes a pair of slots 318A such that the tool body 302A can be assembled to the tool sleeve 304A in four different orientations. The tool body 302A and the tool sleeve 304A can interlock in any possible combination or orientation so long as the long axis of tool body 302A and the tool sleeve 304A are aligned with one another. However, in the illustrated arrangement, the multi tool insert 300A and the buckle 200 can only interlock in one possible combination with the thickest end of the multi tool insert 300A positioned outside of the tool cover 208, as shown in FIG. 1A.

Figure 4E:
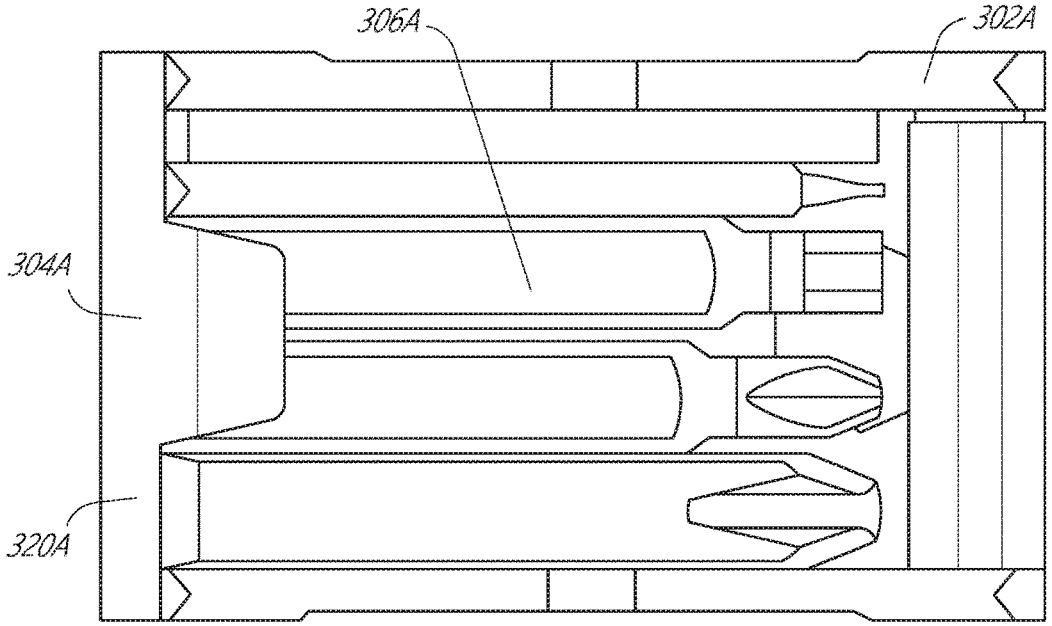
FIG. 4E is a front view of the multi tool insert of FIG. 4C.
Figure 4F:
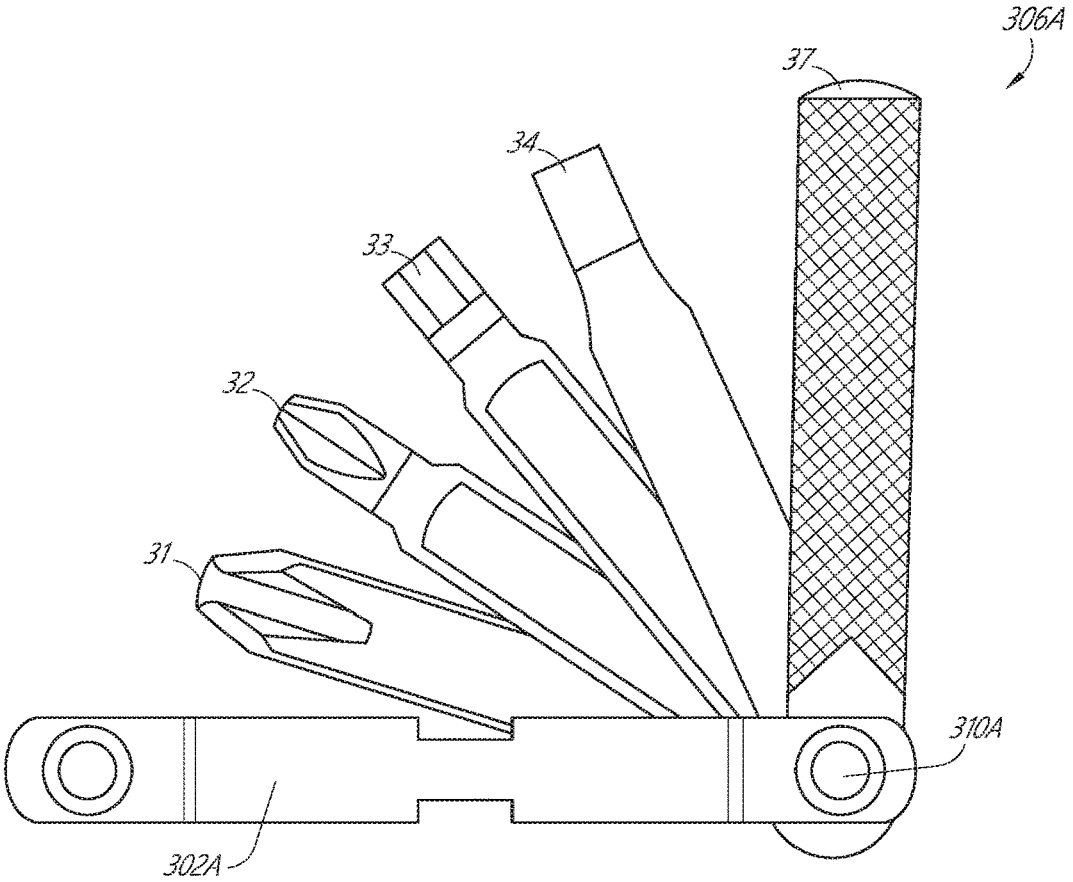
FIG. 4F is a side view of the body of the multi tool insert of FIG. 4B, showing the articulating tools of the multi tool insert.
Figure 5A:
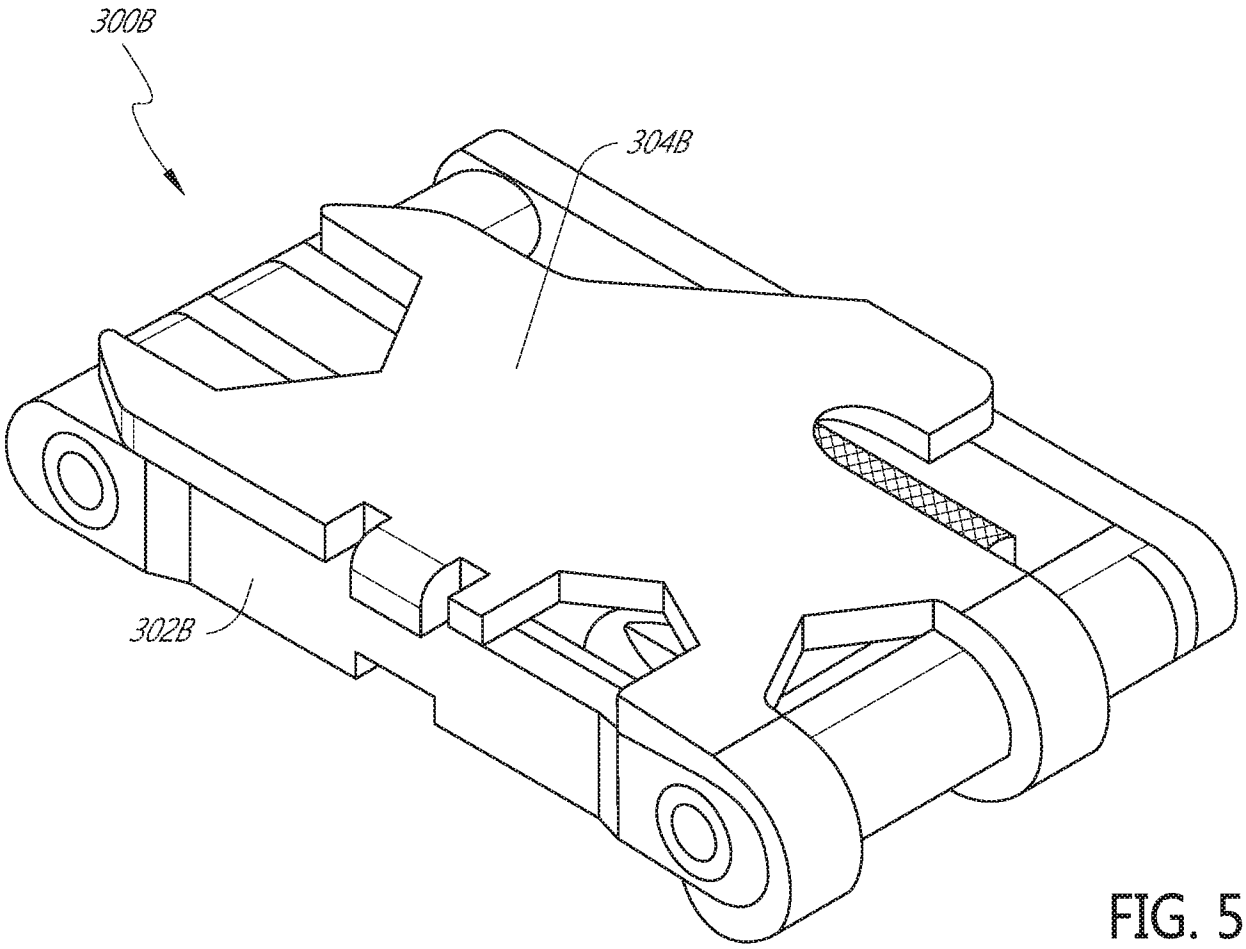
FIG. 5A is a rear perspective view of a multi tool insert.
Figure 5B:
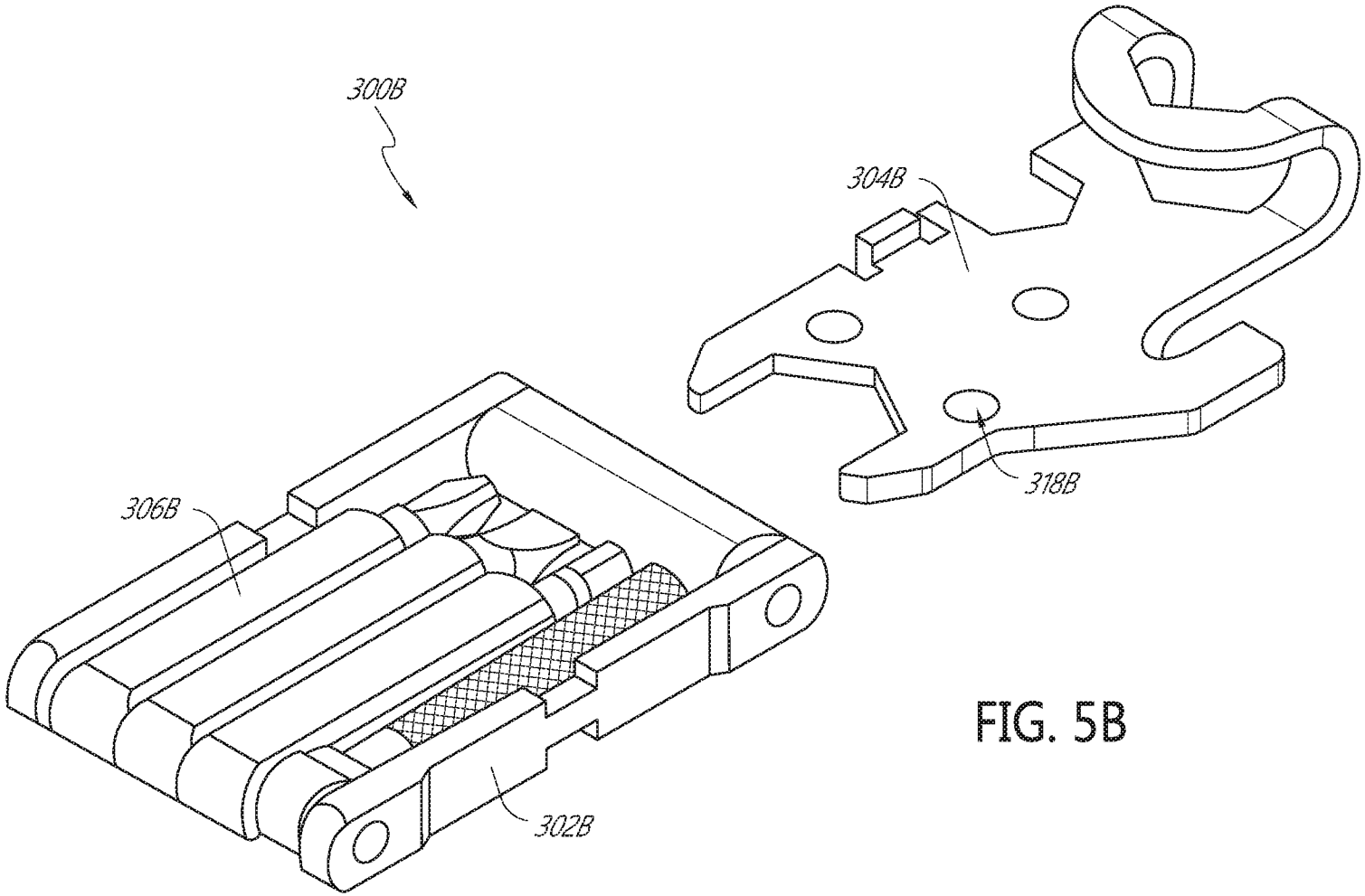
FIG. 5B is a front exploded view of the multi tool insert of FIG. 5A, showing the multi tool body removed from the sleeve.
Figure 5C:
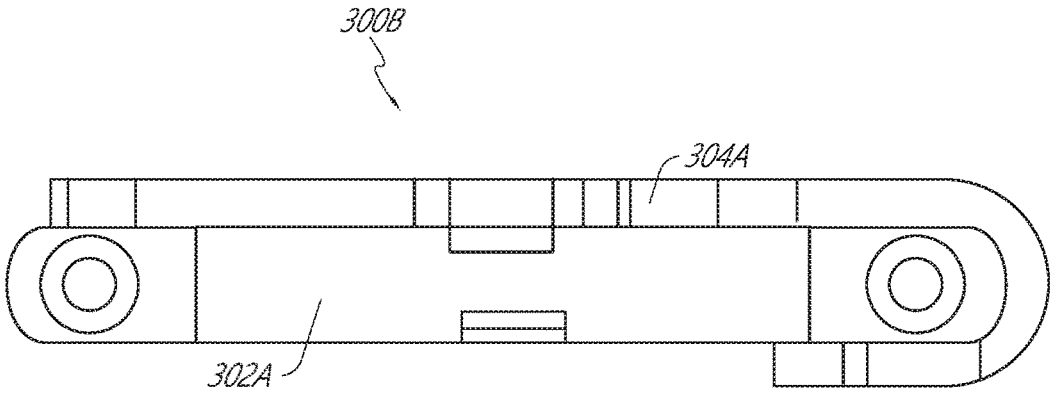
FIG. 5C is a side view of the multi tool insert of FIG. 5B.
Figure 5D:
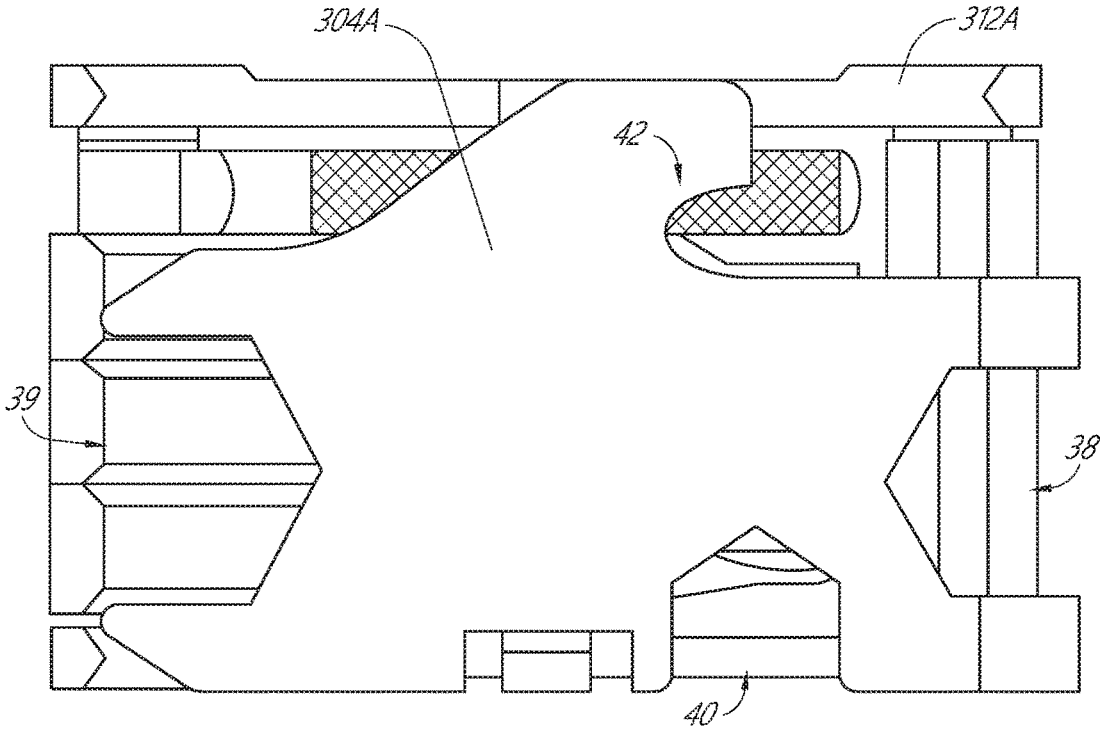
FIG. 5D is a rear view of the multi tool insert of FIG. 5C.
Figure 5E:
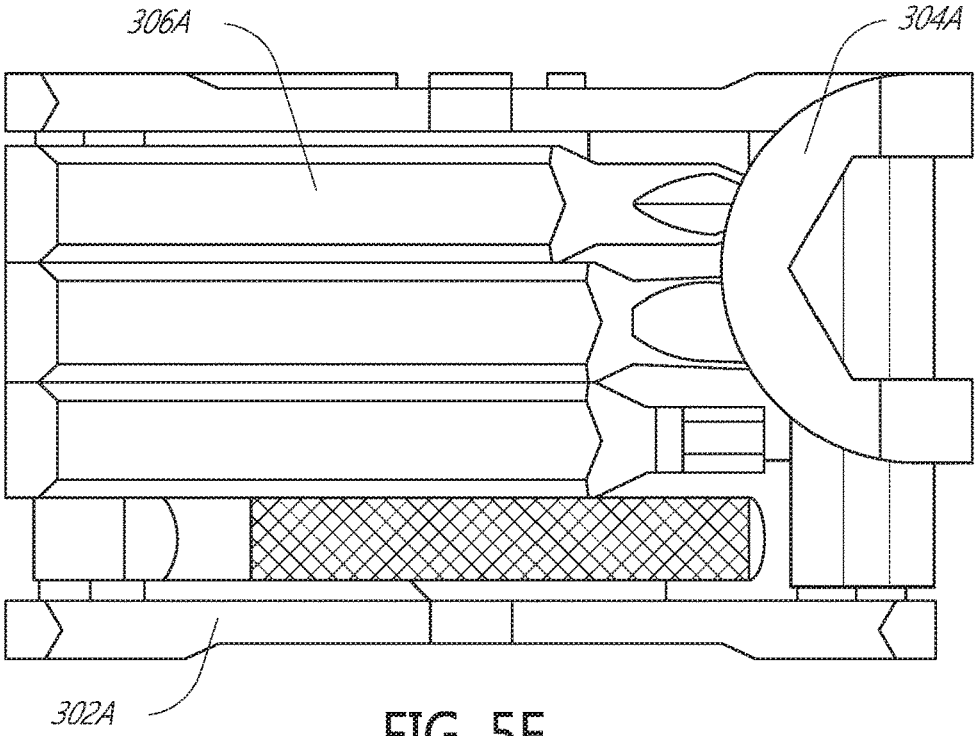
FIG. 5E is a front view of the multi tool insert of FIG. 5C.
Figure 5F:
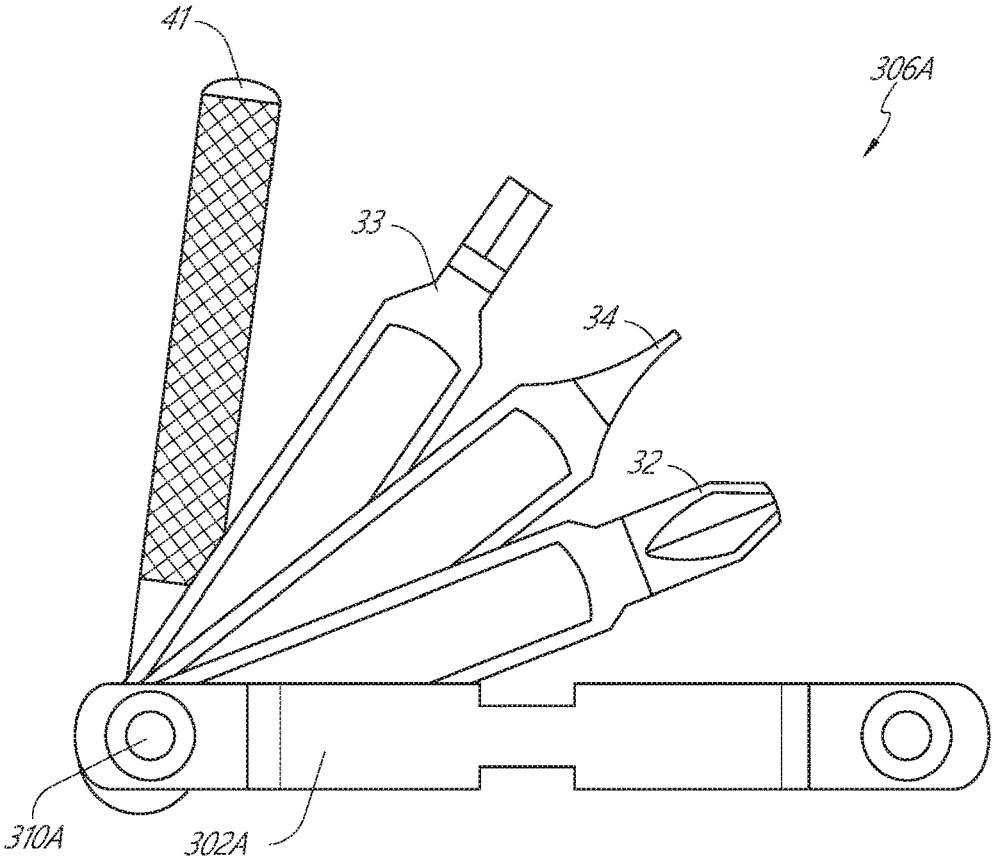
FIG. 5F is a side view of the body of the multi tool insert of FIG. 5B, showing the articulating tools of the multi tool insert.

As mentioned, FIGS. 4A-4F illustrate one example of a multi tool insert 300A that is designed for skiing or snowboarding. This tool 300A can include a #3 Phillips screwdriver 31 to secure binding/board interface bolts. The #3 Phillips screwdriver 31 can be used to tighten a ski binding release or to tighten retention bolts. In some variants, the #3 Phillips screwdriver 31 can be used to fix bindings of a snowboard. When used in conjunction with the tool sleeve 304A, the #3 Phillips 31 can be locked at 90 degrees. As shown in FIG. 4E, the tool sleeve 304A can have a stop 320A that limits the rotation of the #3 Phillips 31. The tool sleeve 304A can include a sharp edge cutting tool 319A. The multi tool insert 300A can include other tools useful for servicing binding components common in snowboarding and skiing. For example, the multi tool insert 300A can include a #2 Phillips 32, a 4 mm hex bit 33, a slotted screwdriver 34, an 8 mm box wrench 35, and a 10 mm box wrench 36. The multi tool insert 300A can include a flat file 37 that can be used to sharpen edges when used in conjunction with the locking tool sleeve 304A.

FIGS. 5A-5F illustrate one example of a multi tool insert 300B that is designed for skateboarding. The multi tool insert 300B is similar to the multi tool insert 300A except as described differently below. The features of the multi tool insert 300B can be combined or included with the multi tool insert 300A or any other embodiment discussed herein. The multi tool insert 300B can include a #2 Phillips screwdriver 32, a slotted screwdriver 34, and a 4 mm hex bit 33, which are commonly used for deck mounting hardware. The tool sleeve 304B can include a 9/16" open end wrench 38, a ½" open end wrench 39, and a ⅜" open end wrench 40 for truck, wheel, and truck mounting nuts. The multi tool insert 300B can include a round file 41, which can be used for revealing the deck edge when new grip tape is applied. When used in conjunction with the recessed sleeve blade 42 of the tool sleeve 304B, grip tape can be applied to a new board in the field with the same quality as from a shop.

Figure 6A:
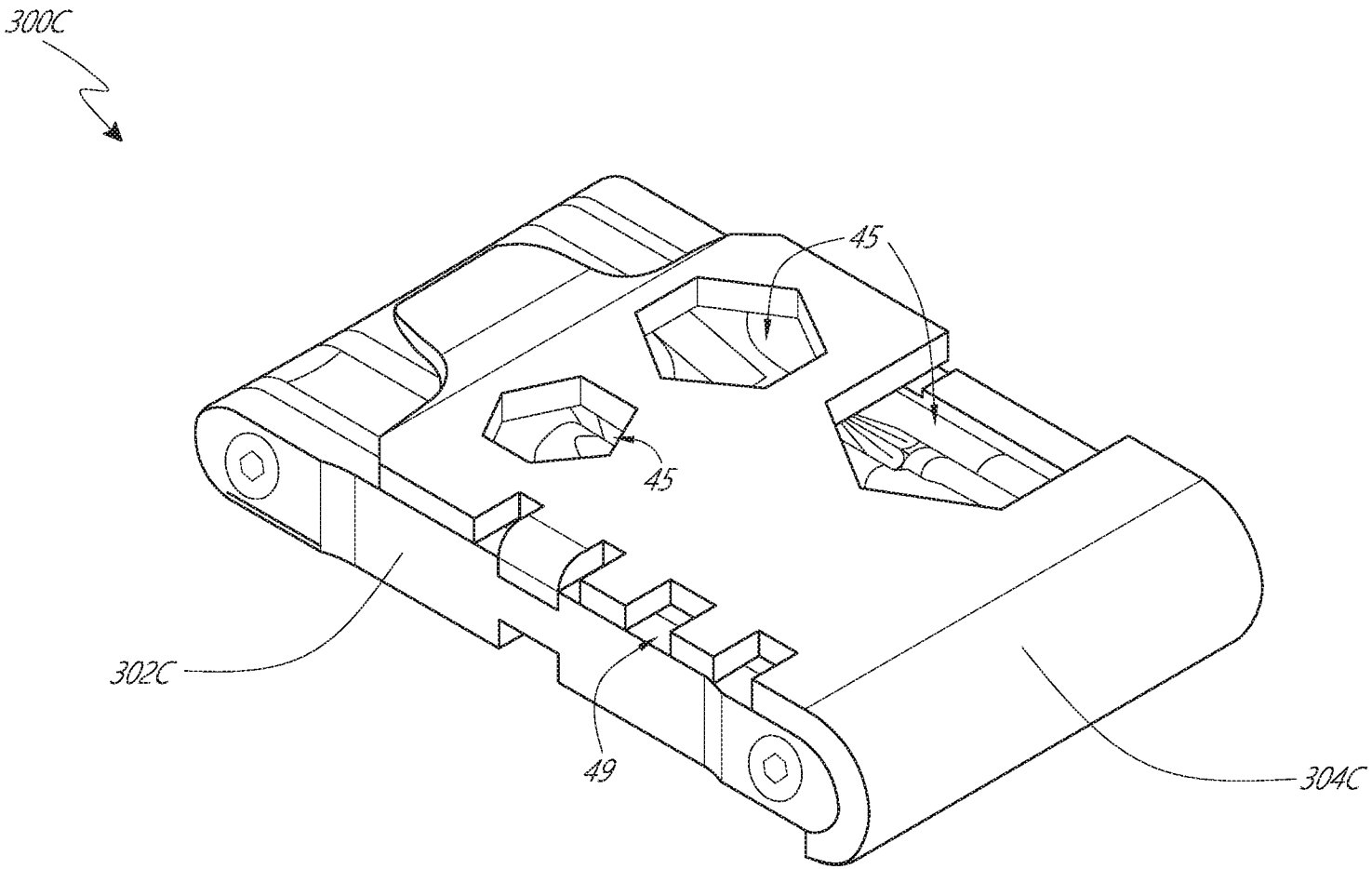
FIG. 6A is a rear perspective view of a multi tool insert.
Figure 6B:
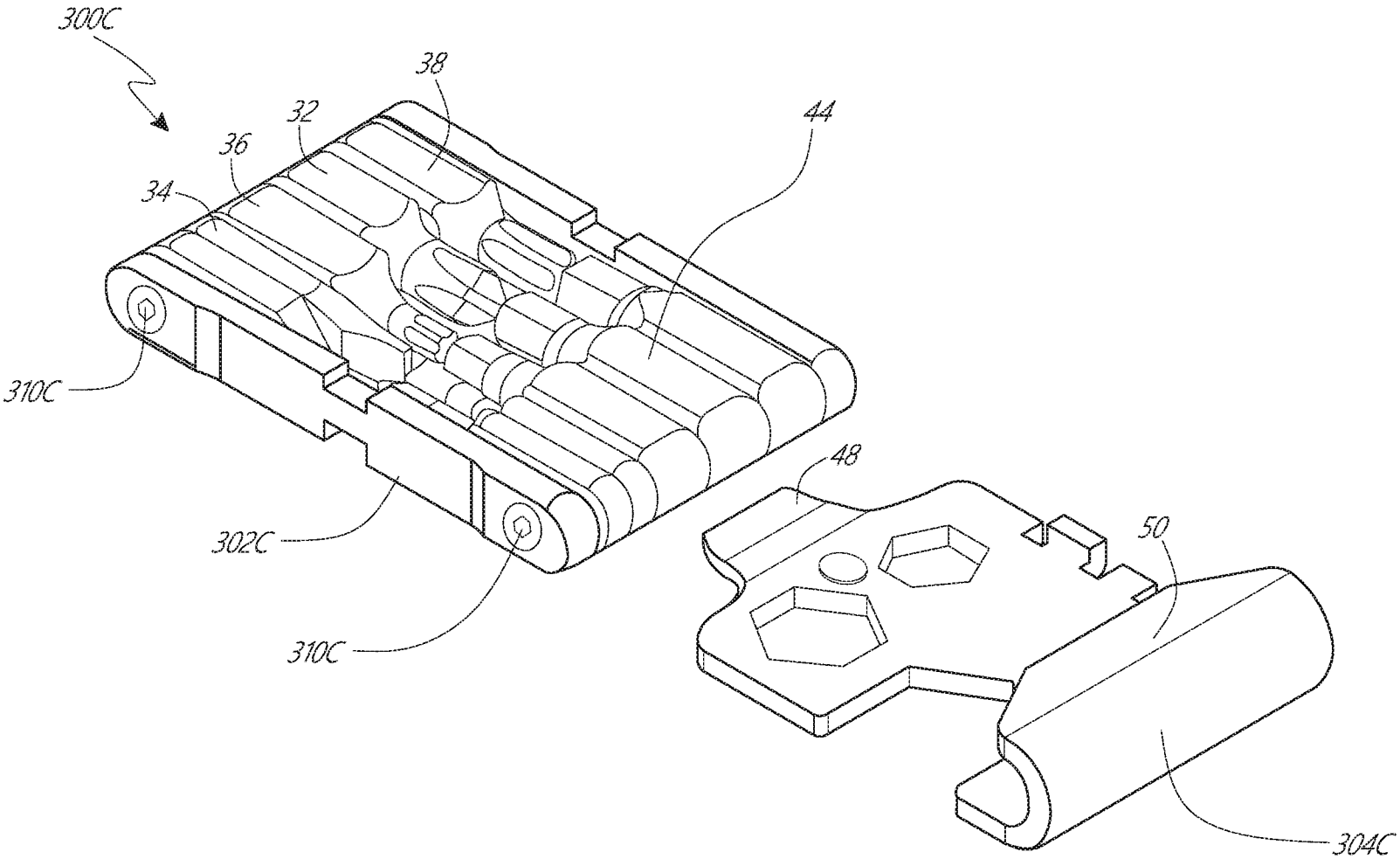
FIG. 6B is a front exploded view of the multi tool insert of FIG. 6A, showing the multi tool body removed from the sleeve.
Figure 6D:
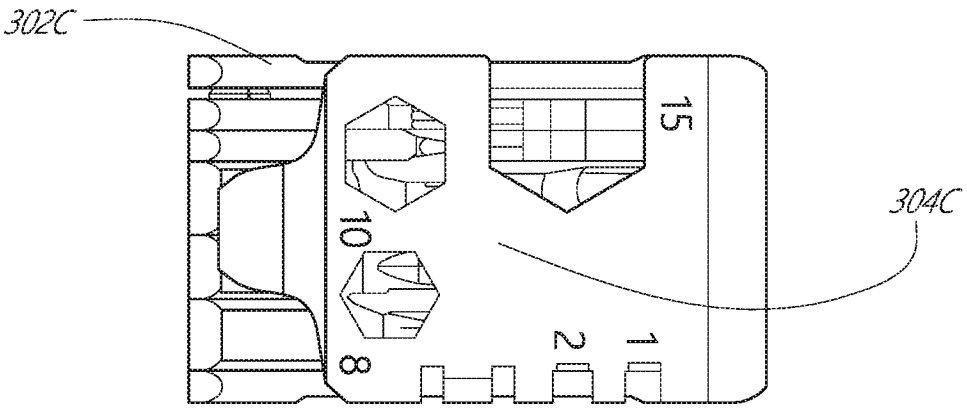
FIG. 6D is a rear view of the multi tool insert of FIG. 6C.
Figure 6C:
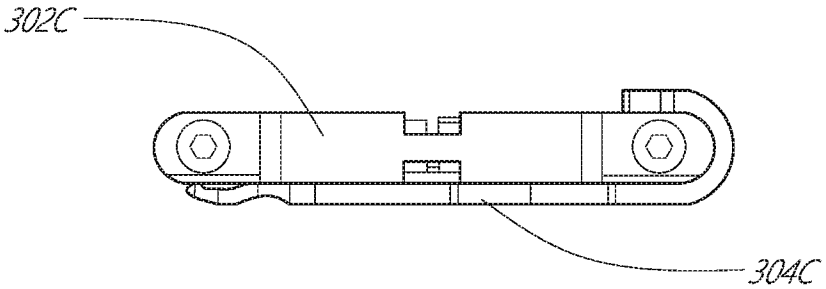
FIG. 6C is a side view of the multi tool insert of FIG. 6B.

FIGS. 6A-6D illustrate one example of a multi tool insert 300C that is designed for cycling. The multi tool insert 300C is similar to the multi tool insert 300B except as described differently below. The features of the multi tool insert 300C can be combined or included with the multi tool insert 300B or any other embodiment discussed herein. As shown in FIG. 6B, the multi tool insert 300C can include two pivots 310C at opposing ends of the tool body 302C. Each of the two pivots 310C can support a set of the articulating tools 306C of the multi tool insert 300C. The multi tool insert 300C can include hex bits 44 that cover the range of 2 mm thru 6 mm (e.g., 2 mm, 2.5 mm, 3 mm, 4 mm, 5 mm and 6 mm) that will fit most bike components. The multi tool insert 300C can include a #2 Phillips 32 and a slotted screwdriver 34 for common derailleur adjustments. The multi tool insert 300C can include Torx T10 and T25 bits, 36 and 38, respectively, for clamp type shifters, levers, and braking components that require higher tension. The multi tool insert 300C can include box wrenches 45 (e.g., 8 mm, 10 mm and 15 mm) that are commonly sized for some BMX axles and seat/reflector clamps and collars. The multi tool insert 300C can include a tire lever 48 for removing stubborn tires. The multi tool insert 300C can include several sizes (e.g., two) of spoke wrenches 49. In some configurations, the multi tool insert 300C includes a bottle opener 50.

Figure 7A:
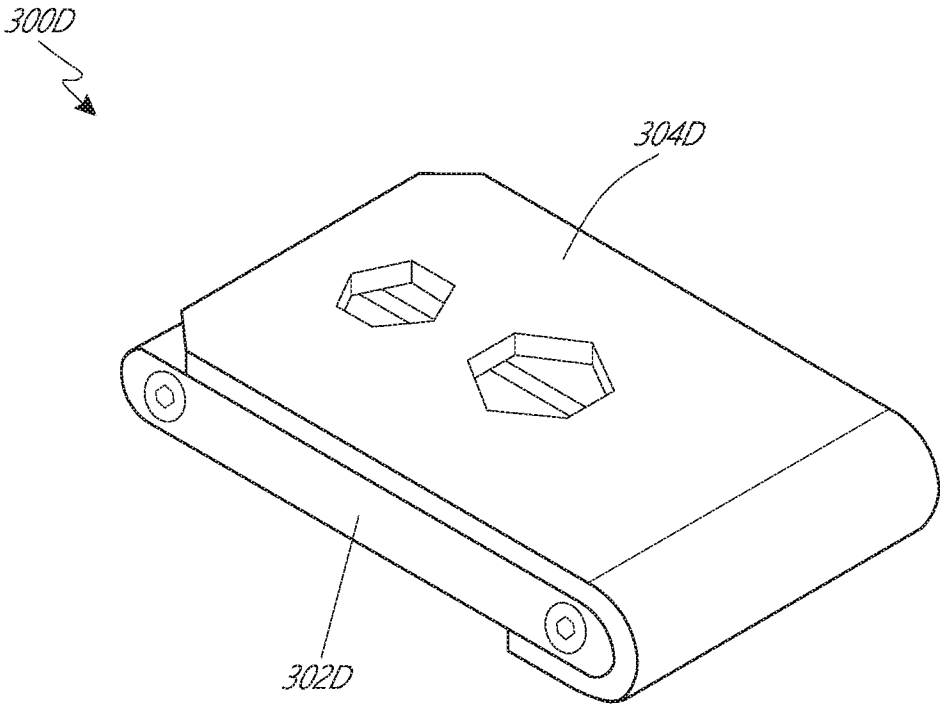
FIG. 7A is a rear perspective view of a multi tool insert.
Figure 7B:
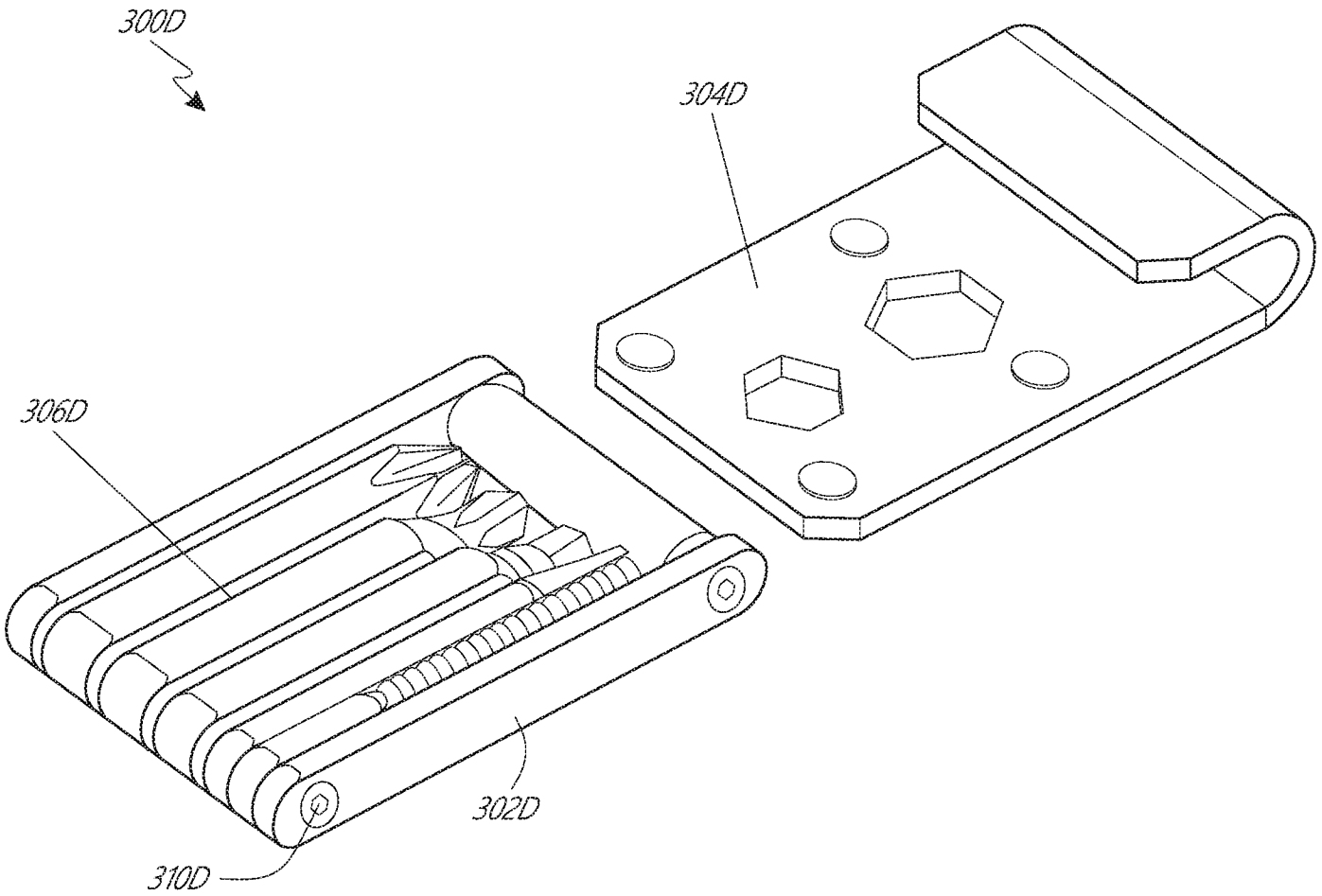
FIG. 7B is a front exploded view of the multi tool insert of FIG. 7A, showing the multi tool body removed from the sleeve.
Figure 7D:
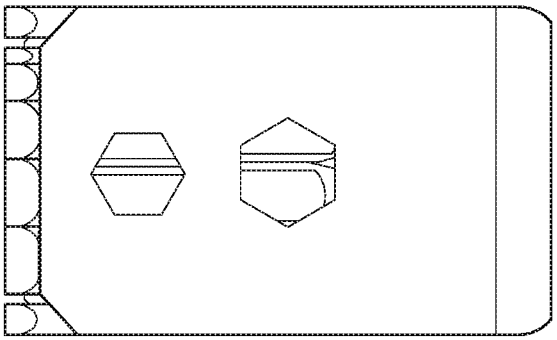
FIG. 7D is a rear view of the multi tool insert of FIG. 7C.
Figure 7C:
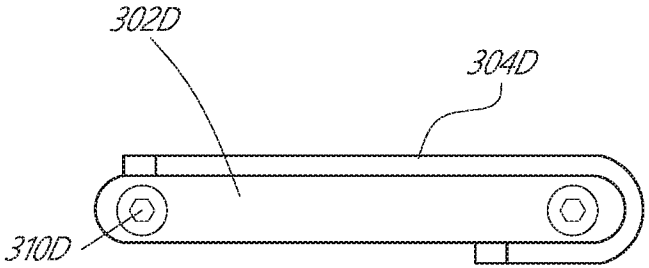
FIG. 7C is a side view of the multi tool insert of FIG. 7B.
Figure 7E:
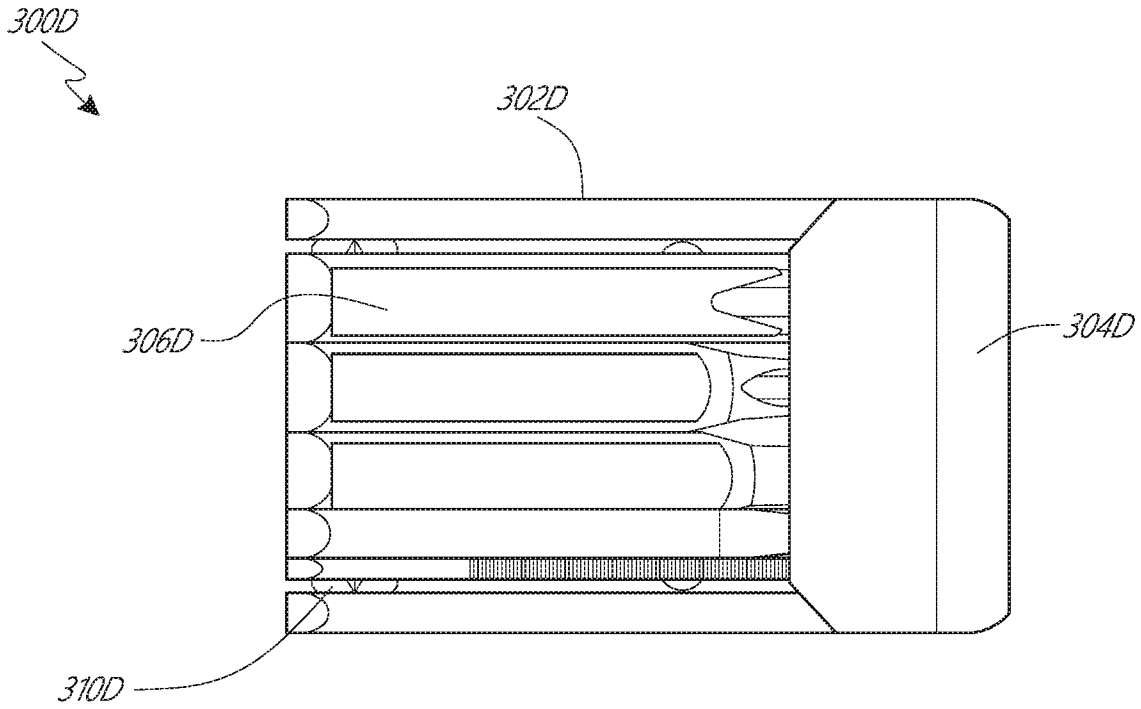
FIG. 7E is a front view of the multi tool insert of FIG. 7C.

FIGS. 7A-7D illustrate a multi tool insert 300D that is similar to the multi tool insert 300A except as described differently below. The features of the multi tool insert 300D can be combined or included with the multi tool insert 300A or any other embodiment discussed herein. As shown in FIG. 7B, the tool body 302D can include articulating tools 306A that are secured by a pivot 310D at an end of the tool body 302D. The tool sleeve 304D can slide onto the opposing end of the tool body 302D so that the tool sleeve 304D wraps around the end of the tool body 302D that is opposite of the pivot 310D that secures the articulating tools 306D.

Figure 8A:
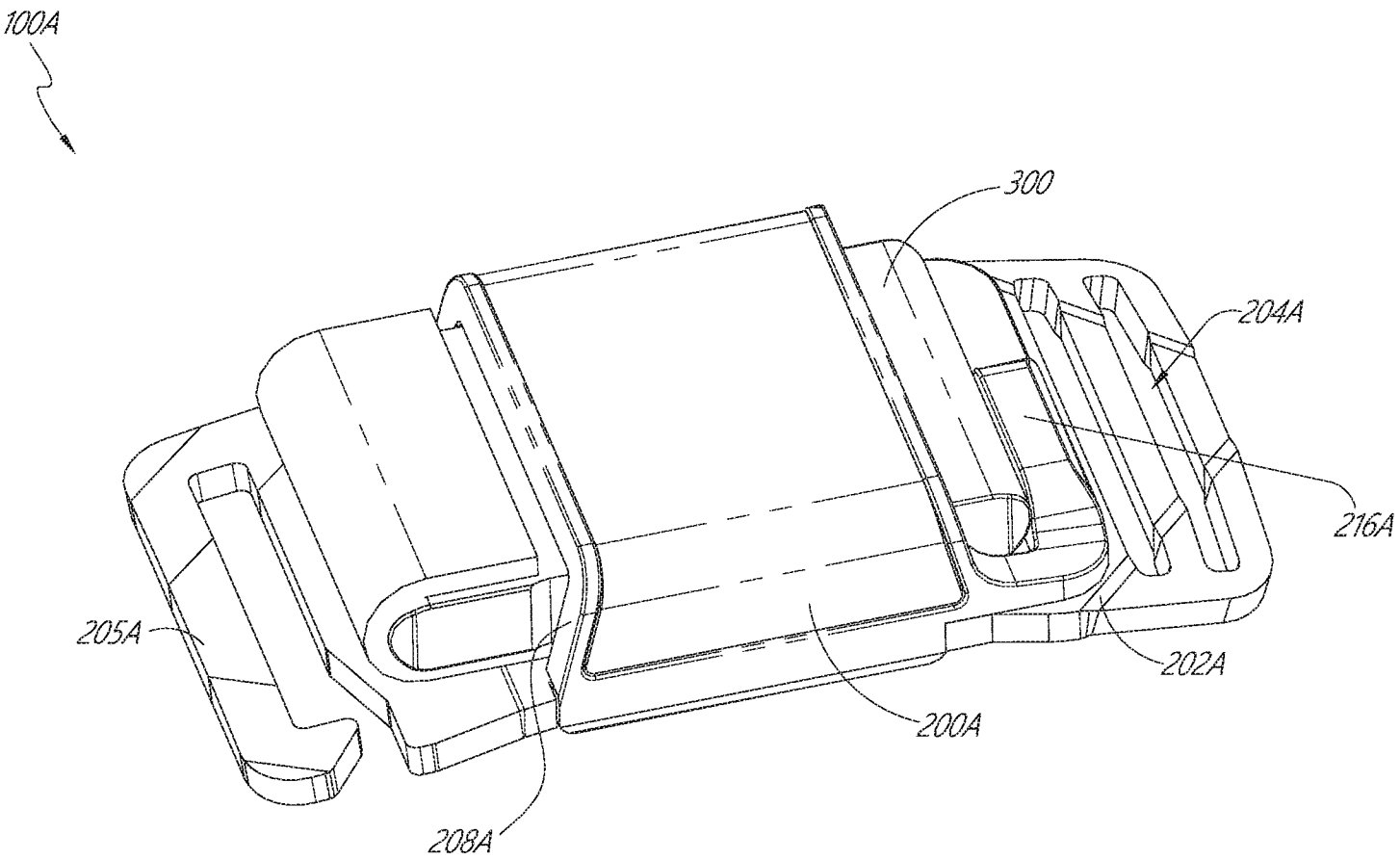
FIG. 8A is a front perspective view of a multi tool buckle assembly.
Figure 8B:
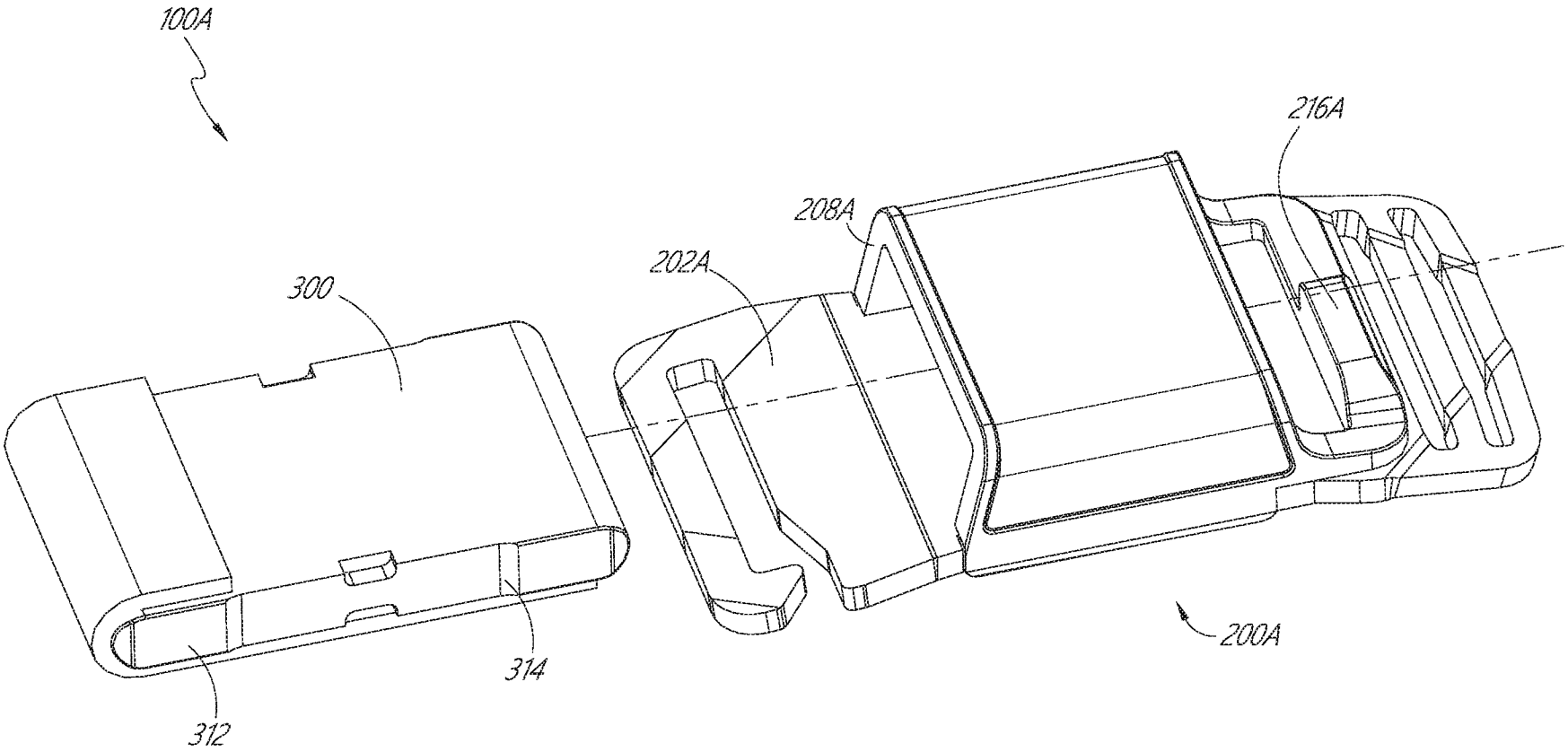
FIG. 8B is the multi tool buckle assembly of FIG. 8A with the multi tool insert removed from the buckle.

FIGS. 8A and 8B show a top view of a non-limiting, illustrative embodiment of a multi tool buckle assembly 100A that is similar to the multi tool buckle assembly 100 except as described differently below. The features of the multi tool buckle assembly 100A can be combined or included with the multi tool buckle assembly 100 or any other embodiment discussed herein. The multi tool buckle assembly 100A can include a buckle 200A that is similar to the buckle 200 except as described differently below. As shown in FIG. 8A, the buckle 200A can receive the multi tool insert 300 or any other embodiment of the multi tool insert 300 discussed herein.

The buckle 200A can include a base plate 202A and a cover 208A that define a receptacle sized to receive the multi tool insert 300, as described previously. The buckle 200A can include a hard stop 216A that prevents or inhibits the multi tool insert 300 from exiting the buckle 200A at the end having the hard stop 216A. As shown in FIG. 8A, the buckle 200A can include features for attaching the buckle 200A to a belt or a strap. In the illustrated embodiment, one end of the base plate 202A includes a pass through 204A and the other end includes a clasp 205A. The clasp 205A can be hook-shaped and define an elongated slot configured to receive a corresponding attachment feature (e.g., a loop of material). In other configurations, the clasp 205A can be configured to deflect to mate the clasp 205A to a corresponding attachment feature (e.g., a bar or post). Other suitable releasable connection arrangements can also be used, such as a snap-fit arrangement, for example.

Figure 8C:
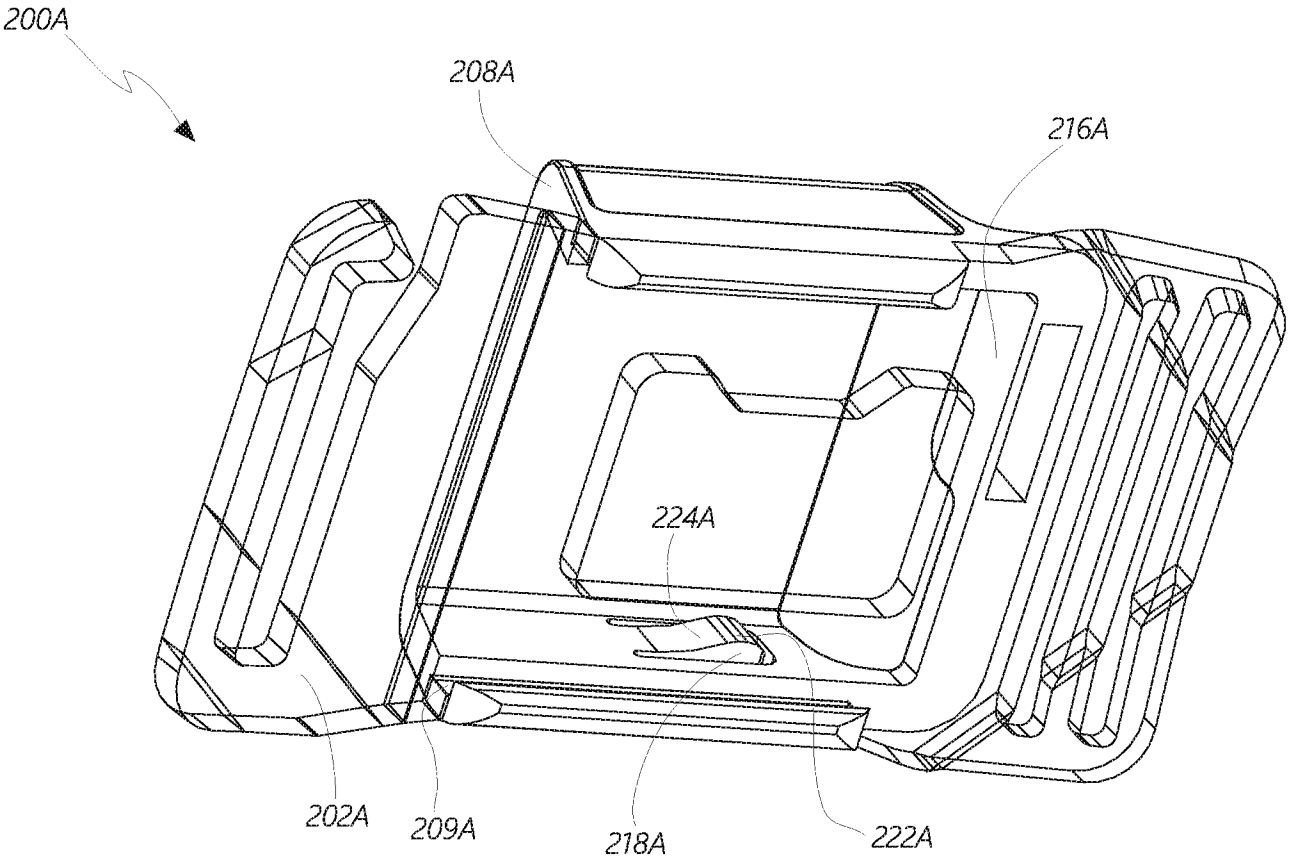
FIG. 8C is a rear view of the buckle of FIG. 8B.

FIG. 8C shows a bottom view of the buckle 200A with the base plate 202A illustrated as being transparent in order to more clearly show the spring clip 218A that extends medially inward from a lateral side of the cover 208A. The spring clip 218A can be similar to the spring clip 218 except as described differently below. The spring clip 218A can form a unitary structure with the cover 208A. For example, in the illustrated embodiment the spring clip 218A has a base portion that extends from, and is unitary with, a side wall of the cover 208A, with the other three sides of the spring clip 218A being surrounded by a U-shaped slot. The spring clip 218A can be flexible, allowing the spring clip 218A to bend at the base portion and deflect toward or away from the opposing lateral side of the cover 208A. The inside surface of the lateral side of the cover 208A can have a groove 209A. The groove 209A can be sized to receive the edge of the base plate 202A, allowing the cover 208A to be attached to the base plate 202A as shown in FIG. 8C.

The spring clip 218A can have a leading face 222A that faces toward the hard stop 216A. The spring clip 218A can have a trailing face 224A that faces away from the hard stop 216A. When the multi tool insert 300 is secured inside the buckle 200A, the spring clip 218A can rest against the recessed portion of the retention plates 312 (shown in FIG. 8B and described above). The leading face 222A can prevent or inhibit the shoulder region 314 of the retention plate 312 from moving past the spring clip 218A, thereby preventing or inhibiting the multi tool insert 300 from dislodging from the buckle 200A during sport applications. As mentioned, the spring clip 218A can be flexible, allowing the shoulder region 314 to force past the spring clip 218A by deflecting the spring clip 218A away from the sagittal plane of the buckle 200A. The shoulder region 314 can be forced past the spring clip 218A by manually applying finger pressure to the multi tool insert 300, as described previously.

Figure 8D:
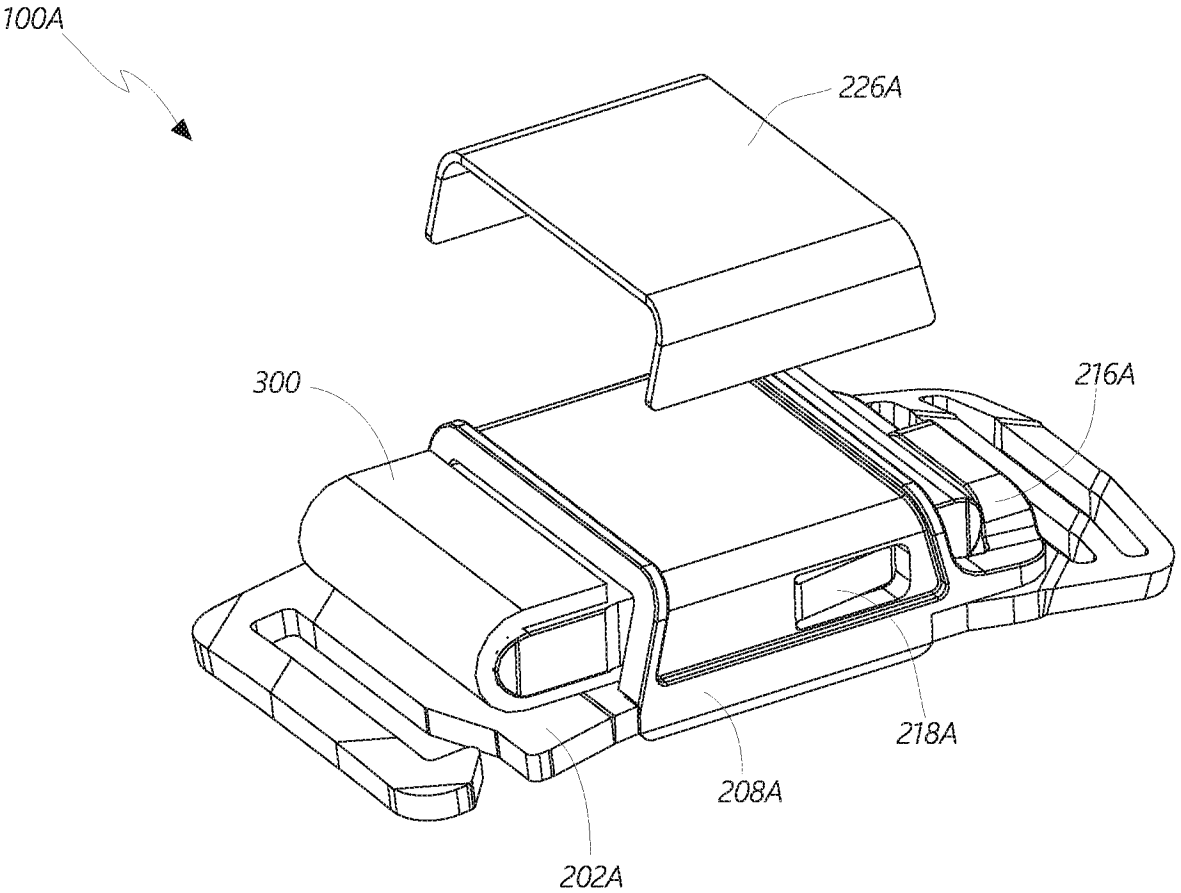
FIG. 8D is a front perspective view of the multi tool buckle assembly of FIG. 8A, showing the shield removed from the cover of the buckle.

FIG. 8D illustrates that the buckle 200A can include a shield 226A. The shield 226A can fit onto the cover 208A and cover the spring clip 218A. The shield 226A can be removable. In some embodiments, the shield 226A can provide an exchangeable cosmetic feature that allows a user to change the appearance of the multi tool buckle assembly 100A.

Figure 8E:
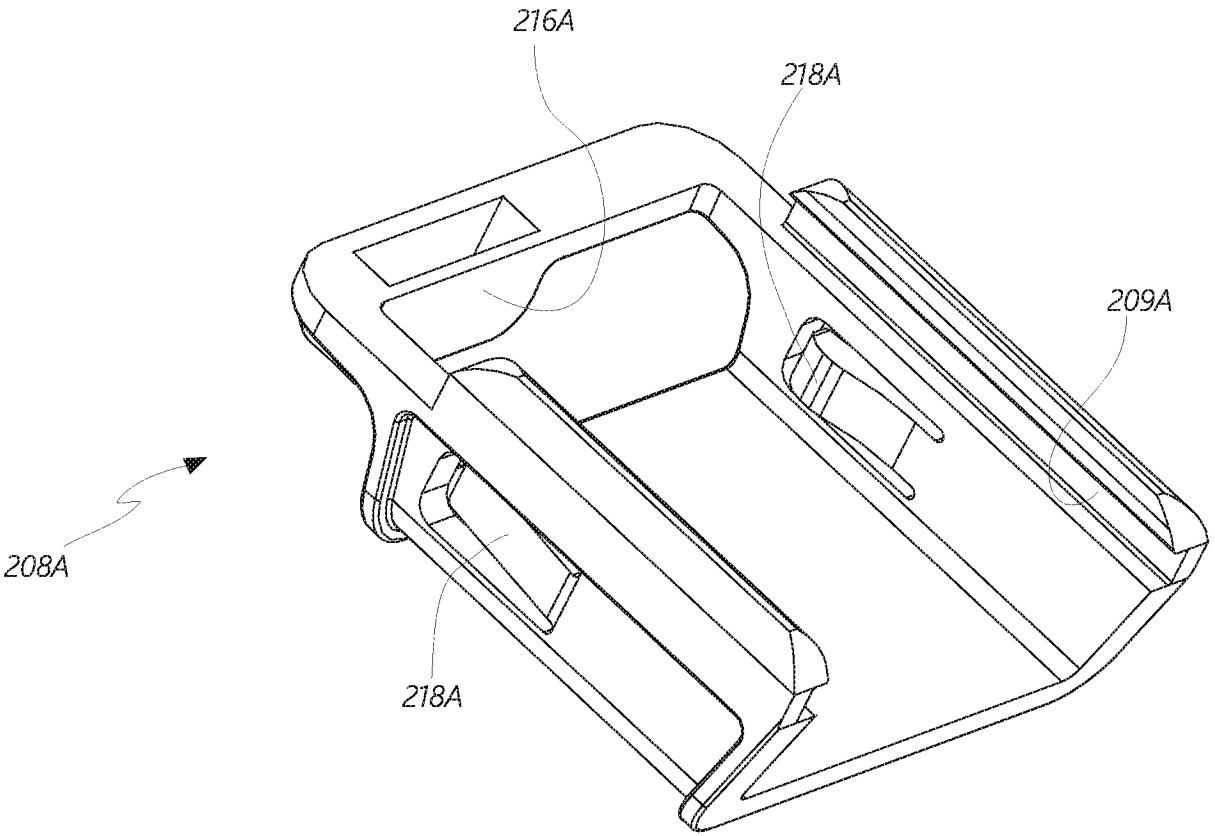
FIG. 8E is a rear perspective view of the cover of FIG. 8B.

FIG. 8E illustrates a bottom view of the cover 208A. As shown in FIG. 8E, the cover 208A can include a pair of spring clips 218A, with each spring clip 218A of the pair disposed on a lateral wall opposite of the other spring clip 218A. The spring clips 218A can be biased to extend toward one another, as shown in FIG. 8E. Advantageously, the illustrated buckle assembly 100A of FIGS. 8A-8E is of a relatively simple construction that can be manufactured in a cost-effective manner. The components of the buckle assembly 100A can be made from any suitable material or combination of materials, such as metal or plastic, by any suitable process or processes, such as machining, stamping, forging, molding, etc. The assembly of the cover 208A to the base plate 202A is also simple and, in at least some embodiments, can be accomplished without the use of tools. The assembly of the cover 208A to the base 202A can be a one-time (permanent) attachment or to the cover 208A can be removable.

Figure 9:
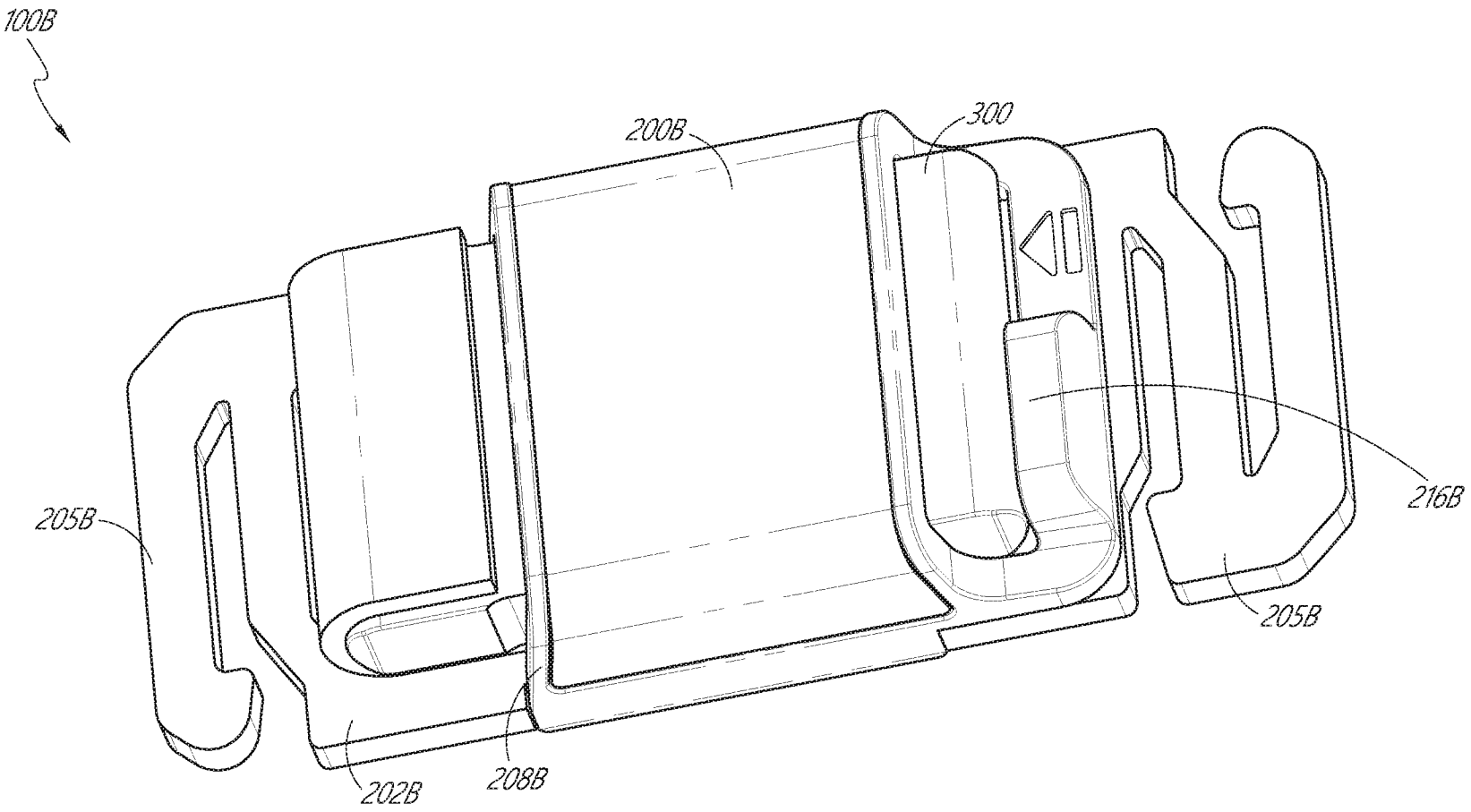
FIG. 9 is a front perspective view of a multi tool buckle assembly having a strap mount.

FIG. 9 shows a top view of a non-limiting, illustrative embodiment of a multi tool buckle assembly 100B that is similar to the multi tool buckle assembly 100A except as described differently below. The features of the multi tool buckle assembly 100B can be combined or included with the multi tool buckle assembly 100A or any other embodiment discussed herein. The multi tool buckle assembly 100B can include a buckle 200B that is similar to the buckle 200A except as described differently below. As shown in FIG. 9, the buckle 200B can receive the multi tool insert 300 or any other embodiment of the multi tool insert 300 discussed herein. The multi tool buckle assembly 100B can include a tool base 202B that is adapted to be mounted on a strap. For example, the tool base 202B can include a clasp 205B disposed on either end of the tool base 202B. In some arrangements, the clasps 205B can be adapted to allow a strap to be attached to each clasp 205B. The multi tool buckle assembly 100B can include a tool cover 208B and a hard stop 216B, as described above.

Figure 10:
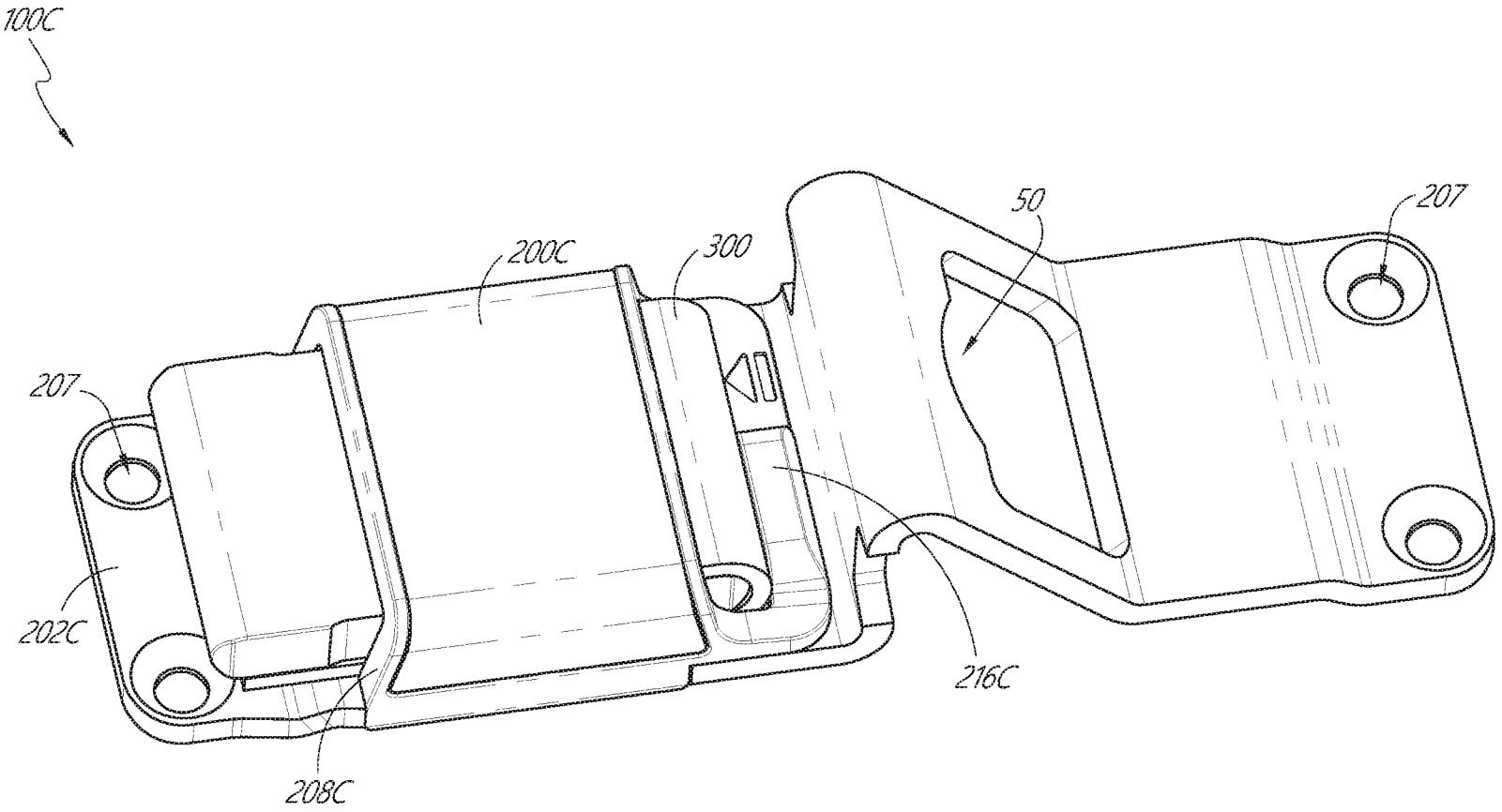
FIG. 10 is a front perspective view of a multi tool buckle assembly having a wall mount.

FIG. 10 shows a top view of a non-limiting, illustrative embodiment of a multi tool buckle assembly 100C that is similar to the multi tool buckle assembly 100B except as described differently below. The features of the multi tool buckle assembly 100C can be combined or included with the multi tool buckle assembly 100B or any other embodiment discussed herein. The multi tool buckle assembly 100C can include a buckle 200C that is similar to the buckle 200B except as described differently below. As shown in FIG. 10, the buckle 200C can receive the multi tool insert 300 or any other embodiment of the multi tool insert 300 discussed herein. The multi tool buckle assembly 100C can include a tool base 202C that is adapted to be mounted on a wall or other substantially flat surface (e.g., skateboard, surfboard). The tool base 202C can include mounting holes 207. A fastener (e.g., screw) can be passed through each of the mounting holes 207 to secure the tool base 202C to a wall or other substantially flat surface. The mounting holes 207 can be disposed on either end of the tool base 202B, as shown in FIG. 10. In some arrangements, the tool base 202B can include a bottle opener 50. The multi tool buckle assembly 100C can include a tool cover 208C and a hard stop 216C, as described previously.

Other Features of Some Embodiments

The buckle 200 and the multi tool insert 300 combination can be arranged such that the wearer will remove the multi tool insert 300 from the buckle 200 with the right hand, given that the majority of the population is right handed. However, in other arrangements, the combination can be designed or otherwise configured to allow removal with the left hand.

The multi tool insert 300 can be removed along the axis of the waist line to prevent having to lift a shirt or jacket above the waistline and expose bare skin when removing the multi tool insert 300 from the multi tool buckle assembly 100 in public. The multi tool buckle assembly 100 can be arranged so that a user can access the multi tool insert 300 from a standing or sitting position. The multi tool buckle assembly 100 can be arranged so that when the buckle 200 is open, in the event that the user needs to use the restroom, the multi tool insert 300 will not fall out of the buckle 200. In certain arrangements, the multi tool insert 300 can be removed from the buckle 200 without having direct line of sight. For example, the multi tool buckle assembly 100 can include clear tactile cues for removal and insertion of the multi tool insert 300. The multi tool buckle assembly 100 can be arranged so that the multi tool insert 300 does not need to be removed from the buckle 200 to secure the belt around the waist. Normal use of the belt and use of the multi tool insert 300 are completely unrelated and do not interfere with each other. The combination of the multi tool insert 300 and the tool housing (in the form of the buckle 200) with specific size requirements creates opportunities to express attachment outside of the size constraints, such as other buckle types and other placements and locations for use.

Alternative Mounting Platform

The primary carrying mode for the multi tool buckle assembly 100 is the belt buckle. However, given the unique interface of the multi tool insert 300 and the buckle 200, the multi tool buckle assembly 100 can easily be mounted on other hard and soft surfaces. For example, the tool base 202 (shown in FIG. 2) can be configured for mounting to another object, which can include but is not limited to clothing (e.g., a jacket), to sporting equipment (e.g., skateboard), to gear (e.g., backpack), and to a vehicle (e.g., motorcycle).

The multi tool buckle assembly 100 can be mounted onto a backpack. Several holes (e.g., 4) can be provided in the tool base 202 (e.g., one at each corner). In certain arrangements, the tool base 202 can be modified to extend beyond the illustrated footprint. A portion of the backpack (e.g., the shoulder strap) can be sandwiched between the tool base 202 and another metal plate that has corresponding holes adapted to align with the holes of the base 202. Rivets can pass through the shoulder strap of a backpack and secure the metal plate to the base 202, thereby securing the multi tool buckle assembly 100 to the backpack.

The multi tool buckle assembly 100 can be mounted onto a jacket. Several holes (e.g., 4) can be provided in the tool base 202 (e.g., one at each corner). In certain arrangements, the tool base 202 can be modified to extend beyond the illustrated footprint. A portion of the jacket (e.g., the fabric near the chest) can be sandwiched between the tool base 202 and another metal plate that has corresponding holes adapted to align with the holes of the base 202. Rivets can pass through the jacket and secure the metal plate to the base 202, thereby securing the multi tool buckle assembly 100 to the jacket. The same construction could also be applied to secure the multi tool buckle assembly 100 on locations at the wrist, forearm, bicep, abdomen, or shoulder portion of the jacket.

The multi tool buckle assembly 100 can be mounted onto cycling shorts. Several holes (e.g., 4) can be provided in the tool base 202 (e.g., one at each corner). In certain arrangements, the tool base 202 can be modified to extend beyond the illustrated footprint. As described above, rivets can sandwich fabric on the hip, just below the hip joint, and be secured with another metal plate that matches the same footprint and attachment holes of the base 202. The same construction could also be applied for locations on the back of the waistline, top of the thigh, or back of the thigh. Any location that avoids joint motion during cycling would be suitable.

The multi tool buckle assembly 100 can be mounted onto snowboard pants. As described above, a number (e.g., 4) of holes can be provided in the tool base 202 (e.g., one at each corner), which can extend beyond the current footprint. Rivets could sandwich the fabric and be secured with another metal plate that matches the same footprint and 4 attachment holes. Optimal locations would be on the thigh or as low as the calf/shin area. Because snowboard bindings do not release in the event of a crash, the hips, rear, or knees would not be favorable as those are usually the first to impact the ground.

The multi tool buckle assembly 100 can be mounted onto a skateboard. A number (e.g., 4) of holes can be provided in the tool base 202 (e.g., one at each corner), which can extend beyond the current footprint. Screws could anchor the tool base 202 to the skateboard. Favorable locations would be clear of the nose, tail, or wheels and on the bottom side of the board as to not interfere with foot locations. The structure of the skateboard would likely not be compromised given the historical use of rails, nose guards, and skid plates. Those are attached similarly with no issues.

The multi tool buckle assembly 100 can be mounted onto a bicycle. For any flat surfaces that are available on a bike frame, the backside of the tool base 202 could be bonded using double sided foam adhesive tape. This would avoid any holes in the frame which could compromise frame integrity. For original equipment manufacturer (OEM) solutions, rivets or screws could be incorporated into the frame design similar to the other mounting solutions.

The multi tool buckle assembly 100 can be mounted onto a snowboard. Any flat surface on the top of the board, clear of the bindings, would be ideal to mount the multi tool buckle assembly 100. The tool base 202 could be bonded using double sided foam adhesive tape. Screws or rivets are not recommended as snowboards rely on a great deal of flex to perform properly and any interruption in flex could result in poor performance or a stress riser.

The multi tool buckle assembly 100 can be mounted onto a motorcycle. For any flat surfaces that are available on the motorcycle, the backside of the tool base 202 could be bonded using double sided foam adhesive tape. This would avoid any holes in the frame which could compromise frame integrity. For OEM solutions, rivets or screws could be incorporated into the frame design similar to the other mounting solutions.

The multi tool buckle assembly 100 can be mounted onto a surfboard. Any flat surface near the rear of the board where the leash is mounted would be ideal. For aftermarket solutions, the tool base 202 can be bonded using double sided foam adhesive tape. The tool base 202 can also be embedded into traction pads. For OEM solutions, a plate can be adapted to match the footprint of the tool base 202 as mentioned for soft goods (e.g., backpacks, jackets). The plate could be glassed in and then the tool base 202 can be attached to the plate as described above.

The multi tool buckle assembly 100 can be mounted onto a helmet. The backside of the tool base 202 could have a shallow curve similar to point of view (POV) camera mounts to allow the multi tool buckle assembly 100 to be mounted to almost any mounting location. In some variants, the multi tool buckle assembly 100 can be mounted onto a helmet via double sided foam adhesive tape.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A buckle assembly comprising:

a tool body comprising at least one articulating tool;

a buckle that defines an envelope sized to receive the tool body, wherein the buckle comprises an opening through which the tool body passes longitudinally to seat the tool body in the envelope;

a hard stop disposed at an end of the envelope opposite the opening, the hard stop configured to prevent the tool body from exiting the end of the envelope opposite the opening; and a retention mechanism disposed within the envelope and configured to resist the tool body exiting the envelope through the opening, wherein the retention mechanism comprises a spring clip configured such that a user can manually overcome a tension of the spring clip with a finger pressure applied to the tool body.

2. The buckle assembly of claim 1, wherein the spring clip is configured to align with a recess on the tool body when the tool body is seated within the envelope.

3. The buckle assembly of claim 1, wherein the buckle is configured to allow the finger pressure to be applied manually to the tool body at the end of the tool body that is adjacent to the hard stop.

4. The buckle assembly of claim 1, further comprising a tool sleeve comprising a plate portion that extends along one side of the tool body, the tool sleeve further comprising a hook portion that extends around an end portion of the tool body.

5. The buckle assembly of claim 4, wherein the tool sleeve comprises one or more tool features.

6. A buckle assembly, comprising:

a multi-tool that is removably securable within the receptacle, wherein the multi-tool comprises a tool body and a tool sleeve that is removably securable to the tool body, wherein the tool sleeve comprises a plate portion and a hook portion, wherein the plate portion extends along a first side of the tool body and the hook portion extends around a first end portion of the tool body and along only a portion of a second side of the tool body opposite the first side such that the tool body can be separated from the tool sleeve by movement of the tool body away from the hook portion, wherein the hook portion faces out when the multi-tool is secured within the receptacle;

a buckle defining a receptacle comprising an opening sized to allow the multi-tool to pass longitudinally through the opening to seat within the receptacle;

a hard stop configured to prevent the multi-tool from exiting an end of the receptacle; and a retention mechanism disposed within the receptacle and configured to resist the multi-tool exiting the receptacle, wherein the retention mechanism comprises a spring clip configured to align with a recess on the multi-tool when the multi-tool is seated within the receptacle, wherein the spring clip is configured such that a user can manually overcome a tension of the spring clip with a finger pressure applied to the multi-tool.

7. The buckle assembly of claim 6, wherein the buckle is configured to allow the finger pressure to be applied manually to the multi-tool at an end of the multi-tool adjacent the hard stop.

8. The buckle assembly of claim 6, further comprising a tool sleeve comprising a plate portion and a hook portion, the plate portion extends along one side of the tool body, the hook portion extends around an end portion of the tool body, wherein the tool sleeve comprises one or more tool features.

* * * * *